US012722764B1

(12) United States Patent
Lad et al.

(10) Patent No.: US 12,722,764 B1
(45) Date of Patent: Sep. 1, 2026

(54) THERMAL MANAGEMENT SYSTEMS AND METHODS THEREOF FOR MARINE VESSELS

(71) Applicant: Brunswick Corporation, Mettawa, IL (US)

(72) Inventors: Aniket Ajay Lad, Urbana, IL (US); Brennan J. Kelly, Urbana, IL (US)

(73) Assignee: Brunswick Corporation, Mettawa, IL (US)

( * ) Notice: Subject to any disclaimer, the term of this patent is extended or adjusted under 35 U.S.C. 154(b) by 240 days.

(21) Appl. No.: 18/633,186

(22) Filed: Apr. 11, 2024

(51) Int. Cl.

| | |
|---|---|
| ***B63H 21/38*** | (2006.01) |
| ***B63J 2/12*** | (2006.01) |
| ***F24H 1/00*** | (2022.01) |
| *B63H 20/28* | (2006.01) |

(52) U.S. Cl.
CPC ..... *B63H 21/383* (2013.01); *B63J 2/12* (2013.01); *F24H 1/009* (2013.01); *B63H 20/28* (2013.01)

(58) Field of Classification Search
CPC ..... B63H 21/383; F01P 3/207
See application file for complete search history.

(56) References Cited

U.S. PATENT DOCUMENTS

| | | | |
|---|---|---|---|
| 3,721,104 | A | 3/1973 | Adler |
| 4,226,606 | A | 10/1980 | Yaeger et al. |
| 4,617,472 | A | 10/1986 | Slavik |
| 5,004,042 | A | 4/1991 | McMorries et al. |
| 5,599,217 | A | 2/1997 | Ferrante |
| 5,746,270 | A | 5/1998 | Schroeder et al. |
| 5,848,536 | A | 12/1998 | Dodge |
| 6,273,771 | B1 | 8/2001 | Buckley et al. |
| 6,525,431 | B1 | 2/2003 | Clucas |

(Continued)

FOREIGN PATENT DOCUMENTS

| | | |
|---|---|---|
| CN | 102407931 | 11/2013 |
| CN | 205930240 U | 2/2017 |

(Continued)

OTHER PUBLICATIONS

Search Report in corresponding Application No. GB2405641.8, dated Sep. 16, 2024, 5 pages.

(Continued)

*Primary Examiner* — Richard G Davis
(74) *Attorney, Agent, or Firm* — Andrus Intellectual Property Law, LLP

(57) ABSTRACT

A thermal management system for a marine vessel includes a first closed loop circuit in which a first heat transfer fluid is circulated, a first refrigeration component cooled or heated by the first heat transfer fluid and configured to cool or heat air within a compartment on the marine vessel, and a first heat exchanger configured to exchange heat between the first heat transfer fluid in the first closed loop circuit and water in a first open loop circuit. The system includes a second closed loop circuit in which a second heat transfer fluid is circulated, a drive system with one or more components which are cooled or heated by the second heat transfer fluid, and a second heat exchanger configured to exchange heat between the second heat transfer fluid in the second closed loop circuit and the first heat transfer fluid in the first closed loop circuit.

20 Claims, 23 Drawing Sheets

(56) References Cited

U.S. PATENT DOCUMENTS

| | | | | |
|---|---|---|---|---|
| 6,612,504 | B2 * | 9/2003 | Sendzik | B63J 2/14 165/41 |
| 7,066,777 | B2 | 6/2006 | Maseltee | |
| 7,089,955 | B1 | 8/2006 | Komro, Sr. | |
| 7,094,118 | B1 | 8/2006 | Phillips et al. | |
| 7,114,469 | B1 | 10/2006 | Taylor | |
| 7,150,664 | B1 | 12/2006 | Uppgard et al. | |
| 7,156,709 | B1 | 1/2007 | Staerzl et al. | |
| 7,172,831 | B2 | 2/2007 | Jaura et al. | |
| 7,255,616 | B1 | 8/2007 | Caldwell | |
| 7,264,520 | B1 | 9/2007 | Taylor et al. | |
| 7,284,710 | B2 | 10/2007 | Rixen | |
| 7,416,456 | B1 | 8/2008 | Gonring et al. | |
| 7,467,595 | B1 | 12/2008 | Lanyi et al. | |
| 7,503,819 | B1 | 3/2009 | Jaeger et al. | |
| 7,569,954 | B2 | 8/2009 | Tolle et al. | |
| 7,789,176 | B2 | 9/2010 | Zhou | |
| 7,975,637 | B1 | 7/2011 | Nida | |
| 8,011,982 | B1 | 9/2011 | Baier et al. | |
| 8,043,132 | B1 | 10/2011 | Wyant | |
| 8,137,146 | B2 | 3/2012 | Cohen | |
| 8,298,025 | B2 | 10/2012 | Eichinger | |
| 8,336,319 | B2 | 12/2012 | Johnston et al. | |
| 8,403,234 | B2 | 3/2013 | Wolter | |
| 8,500,501 | B1 | 8/2013 | Taylor | |
| 8,535,104 | B1 | 9/2013 | Nida | |
| 8,763,566 | B1 | 7/2014 | Taylor et al. | |
| 8,864,538 | B1 | 10/2014 | Arbuckle et al. | |
| 8,944,865 | B1 | 2/2015 | Krabacher et al. | |
| 9,234,450 | B2 | 1/2016 | England et al. | |
| 9,248,898 | B1 | 2/2016 | Kirchhoff et al. | |
| 9,359,057 | B1 | 6/2016 | Andrasko et al. | |
| 9,403,588 | B1 | 8/2016 | George et al. | |
| 9,446,828 | B1 | 9/2016 | Groeschel et al. | |
| 9,446,830 | B2 | 9/2016 | Hartmeyer et al. | |
| 9,505,307 | B2 | 11/2016 | Champagne et al. | |
| 9,680,190 | B1 | 6/2017 | Xia | |
| 9,758,010 | B2 | 9/2017 | Johnston | |
| 9,802,459 | B2 | 10/2017 | Kamps et al. | |
| 9,802,687 | B2 | 10/2017 | Davis et al. | |
| 9,815,539 | B1 | 11/2017 | Provost | |
| 9,975,619 | B1 | 5/2018 | Gonring | |
| 9,994,296 | B1 | 6/2018 | Balogh et al. | |
| 10,047,661 | B1 | 8/2018 | Torgerud | |
| 10,151,539 | B2 | 12/2018 | Kamps et al. | |
| 10,184,684 | B2 | 1/2019 | Kurelowech | |
| 10,336,429 | B1 | 7/2019 | Amerling et al. | |
| 10,378,423 | B1 | 8/2019 | Reichardt et al. | |
| 10,408,548 | B2 | 9/2019 | Bell et al. | |
| 10,495,025 | B2 | 12/2019 | Bell et al. | |
| 10,594,510 | B1 | 3/2020 | Arbuckle et al. | |
| 10,889,205 | B2 | 1/2021 | Hettrich | |
| 10,890,098 | B1 | 1/2021 | Kurzynski et al. | |
| 10,967,702 | B2 * | 4/2021 | Mancini | B60H 1/00564 |
| 11,072,408 | B1 | 7/2021 | Kurzynski et al. | |
| 11,214,114 | B2 | 1/2022 | Smith | |
| 11,286,027 | B1 | 3/2022 | Dharmadhikari et al. | |
| 11,293,335 | B1 | 4/2022 | Radavich et al. | |
| 11,352,937 | B1 | 6/2022 | Dreyer et al. | |
| 11,358,434 | B2 * | 6/2022 | Porras | B60H 1/32281 |
| 2002/0079376 | A1 | 6/2002 | R. Enander | |
| 2003/0226904 | A1 | 12/2003 | Haklander | |
| 2004/0142295 | A1 | 7/2004 | Holden | |
| 2006/0130888 | A1 | 6/2006 | Yamaguchi et al. | |
| 2007/0147809 | A1 | 6/2007 | Rixen | |
| 2010/0279153 | A1 | 11/2010 | Payne | |
| 2012/0152186 | A1 | 6/2012 | Sujan | |
| 2012/0180997 | A1 | 7/2012 | Johnston | |
| 2016/0059949 | A1 | 3/2016 | Rebele et al. | |
| 2016/0107505 | A1 | 4/2016 | Johnston | |
| 2018/0086427 | A1 * | 3/2018 | Stimmel | F01P 3/205 |
| 2018/0178615 | A1 | 6/2018 | Xia | |
| 2018/0354339 | A1 | 12/2018 | Smith et al. | |
| 2018/0372334 | A1 | 12/2018 | Walker | |
| 2019/0176572 | A1 | 6/2019 | Kim | |
| 2019/0383563 | A1 | 12/2019 | He et al. | |
| 2020/0255112 | A1 | 8/2020 | Doremus et al. | |
| 2020/0370463 | A1 * | 11/2020 | Saruwatari | F01P 3/202 |
| 2021/0197692 | A1 | 7/2021 | Hettrich | |
| 2022/0097484 | A1 * | 3/2022 | Rixens | F24D 12/02 |
| 2022/0111700 | A1 | 4/2022 | Henderson | |
| 2022/0115719 | A1 | 4/2022 | King | |
| 2023/0242230 | A1 | 8/2023 | Nakagawa | |
| 2023/0382187 | A1 | 11/2023 | Höfler | |
| 2024/0067049 | A1 | 2/2024 | Kim | |

FOREIGN PATENT DOCUMENTS

| | | | |
|---|---|---|---|
| CN | 108482064 | | 9/2018 |
| CN | 209441180 | U | 9/2019 |
| CN | 110588277 | | 12/2019 |
| CN | 112678139 | | 4/2021 |
| CN | 112682157 | | 4/2021 |
| CN | 213743657 | U | 7/2021 |
| CN | 114523816 | B | 11/2022 |
| DE | 102009056027 | | 1/2014 |
| DE | 102021131215 | | 6/2022 |
| EP | 2044370 | | 4/2009 |
| EP | 2907739 | | 8/2015 |
| EP | 3454401 | | 5/2021 |
| GB | 2388184 | A | 11/2003 |
| JP | 2006103537 | A | 4/2006 |
| JP | 2014239607 | A | 12/2014 |
| KR | 20160124540 | A | 10/2016 |
| KR | 20170021142 | A | 2/2017 |
| KR | 20210015197 | A | 2/2021 |
| KR | 102542738 | | 6/2023 |
| WO | WO 2010102606 | | 9/2010 |
| WO | WO 2011005775 | | 1/2011 |
| WO | WO 2013029808 | A1 | 3/2013 |
| WO | 2013124610 | A2 | 8/2013 |
| WO | WO 2021055758 | A1 | 3/2021 |

OTHER PUBLICATIONS

Search Report in corresponding Application No. EP24171732.1, dated Oct. 9, 2024, 8 pages.

Whale RV Catalog, pp. 8-9, https://www.delzer.com/navico/whale-rv-catalog/8/, accessed Apr. 11, 2024.

Dharmadhikari et al., "Marine Drives And Marine Vessels Having Cooling Systems", U.S. Appl. No. 17/978,758, filed Nov. 1, 2022.

Dharmadhikari et al., "Thermal Management Systems And Methods For Thermally Managing Components For Marine Vessels", U.S. Appl. No. 17/900,470, filed Aug. 31, 2022.

Dharmadhikari et al., "Thermal Management Systems For Marine Vessels", U.S. Appl. No. 17/988,104, filed Nov. 16, 2022.

Kelly, "Thermal Management Systems For Marine Vessels", U.S. Appl. No. 17/977,570, filed Oct. 31, 2022.

Denso, Heat Pump Air-Conditioning System, https://www.denso.com/global/en/business/products-and-services/mobility/pick-up/hpacs/, accessed Apr. 13, 2023.

Naik et al., "Marine Propulsion System And Method For Wake Control", U.S. Appl. No. 17/903,938, filed Sep. 6, 2022.

Camco Marine, Kuuma 11 Gallon Marine Water Heater—120V Front Heat Exchanger Front/Back Mount, https://www.camcomarine.com/products/11-gal-water-heater-120v-front-heat-exch-fr-back-mount, accessed Nov. 10, 2023.

Witte, John, "Cooling System For A Marine Vessel", U.S. Appl. No. 18/053,513, filed Nov. 8, 2022.

Eadie et al., "Thermal Management Systems And Methods For Recreational Vehicles", U.S. Appl. No. 18/310,250, filed May 1, 2023.

"Variable-speed inverter scroll compressors" accessed from Inverter scroll compressors | Precision and efficiency | Danfoss on Feb. 22, 2024.

* cited by examiner

THERMAL MANAGEMENT SYSTEMS AND METHODS THEREOF FOR MARINE VESSELS

FIELD

The present disclosure generally relates to thermal management systems and methods thereof for marine vessels.

BACKGROUND

The following U.S. Patents are incorporated herein by reference in entirety.

U.S. Pat. No. 7,975,637 discloses methods and apparatuses for controlling the temperature of batteries in a hybrid marine vessel utilizing a compartment to store the batteries and various conduits to conduct air to and from that compartment. A heat exchanger can draw air from the compartment and cool the air for use in the cabin of the marine vessel. The air from the cabin can be directed into the compartment to provide a flow of air that carries heat away from the batteries in the compartment and toward the heat exchanger.

U.S. Pat. No. 8,864,538 discloses systems and methods for cooling a marine propulsion system on a marine vessel. A lift pump pumps raw cooling water from a body of water in which the marine vessel is situated. The lift pump pumps the raw cooling water through an open cooling circuit from an upstream inlet for receiving the raw cooling water to a downstream outlet for discharging the cooling water back to the body of water. A control circuit controls operation of the lift pump. At least one sensing device indicates whether the lift pump is connected to the body of water. The sensing device is in communication with the control circuit. The control circuit prevents operation of the lift pump when the sensing device indicates that the lift pump is not connected to the body of water.

U.S. Pat. No. 9,403,588 discloses systems for cooling a marine engine operated in a body of water. The systems can include an open loop cooling circuit for cooling the marine engine. The open loop cooling circuit is configured to convey cooling water from the body of water to the marine engine so that heat is exchanged between the cooling water and the marine engine. A pump is configured to pump the cooling water from upstream to downstream through the open loop cooling circuit. A heat exchanger is configured to cause an exchange of heat between the cooling water located upstream of the marine engine and the cooling water located downstream of the marine engine to thereby warm the cooling water located upstream of the marine engine, prior to cooling the marine engine.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain independent examples, a thermal management system for a marine vessel includes a first closed loop circuit in which a first heat transfer fluid is circulated, a first refrigeration component cooled or heated by the first heat transfer fluid and configured to cool or heat air within a compartment on the marine vessel, a first open loop circuit, a first pump configured to pump water from a body of water in which the marine vessel is operating, through the first open loop circuit, and back to the body of water, and a first heat exchanger configured to exchange heat between the first heat transfer fluid in the first closed loop circuit and the water in the first open loop circuit. The system includes a second closed loop circuit in which a second heat transfer fluid is circulated, a drive system with one or more components which are cooled or heated by the second heat transfer fluid, and a second heat exchanger configured to exchange heat between the second heat transfer fluid in the second closed loop circuit and the first heat transfer fluid in the first closed loop circuit.

Optionally, the first heat transfer fluid receives heat from the second heat transfer fluid via the first heat exchanger and the second heat transfer fluid cools the one or more components of the drive system. Optionally, a variable speed and/or direction compressor is configured to convey the first heat transfer fluid. Optionally, a second pump is configured to pump the second heat transfer fluid through the second closed loop circuit. Optionally, the system includes a second open loop circuit and a second pump configured to pump water from a body of water in which the marine vessel is operating, through the second open loop circuit, and back to the body of water and a third heat exchanger configured to exchange heat between the second heat transfer fluid in the second closed loop circuit and the water in the second open loop circuit. Optionally, the first heat transfer fluid receives heat from the second heat transfer fluid via the first heat exchanger and the water receives heat from the second heat transfer fluid via the third heat exchanger and the second heat transfer fluid cools the components of the drive system. Optionally, a water heater is configured to receive heat from the first heat transfer fluid in the first closed loop circuit and/or the second heat transfer fluid in the second closed loop circuit to thereby heat potable water in the water heater. Optionally, a water heater is configured to receive heat from the first heat transfer fluid in the first closed loop circuit to thereby heat potable water in the water heater, and a fourth heat exchanger is configured to exchange heat between the first heat transfer fluid and the potable water. Optionally, a water heater is configured to receive heat from the first heat transfer fluid in the first closed loop circuit to thereby heat potable water in the water heater and a coil through which the first heat transfer fluid is conveyed such that the first heat transfer fluid exchanges heat with the potable water via the coil. Optionally, a water heater is configured to receive heat from the second heat transfer fluid in the second closed loop circuit to thereby heat potable water in the water heater and a coil through which the second heat transfer fluid is conveyed such that the second heat transfer fluid exchanges heat with the potable water via the coil. Optionally, a compartment heat exchanger through which the second closed loop circuit extends and configured to exchange heat between the second heat transfer fluid and the air within the compartment. Optionally, the compartment heat exchanger is configured such that the air in the compartment receives heat from the second heat transfer fluid and the second heat transfer fluid cools the components of the drive system.

In certain independent examples, a method for operating a thermal management system of a marine vessel includes circulating a first heat transfer fluid through a first closed loop circuit, cooling or heating a refrigeration component with the first heat transfer fluid such that the refrigeration component cools or heats air in a compartment of the marine vessel, pumping water from a body of water in which the marine vessel is operating through a first open loop circuit and back to the body of water, circulating a second heat transfer fluid through a second closed loop circuit, cooling or heating one or more components of a drive system with the second heat transfer fluid, and exchanging heat between the second heat transfer fluid in the second closed loop circuit and the first heat transfer fluid in the first closed loop circuit.

Optionally, the method includes pumping water from a body of water in which the marine vessel is operating through a second open loop circuit and back to the body of water and exchanging heat between the second heat transfer fluid of the second closed loop circuit and the water in the second open loop circuit. Optionally, wherein the exchanging heat between the second heat transfer fluid in the second closed loop circuit and the first heat transfer fluid in the first closed loop circuit is facilitated by a first heat exchanger; and wherein the exchanging heat between the second heat transfer fluid of the second closed loop circuit and the water in the second open loop circuit is facilitated by a second heat exchanger. Optionally, the method includes receiving heat into a water heater from the first closed loop circuit and/or the second closed loop circuit to thereby heat potable water in the water heater. Optionally, the method includes exchanging heat between the first heat transfer fluid in the first closed loop circuit and potable water in a potable water in a potable by conveying the first heat transfer fluid and the potable water through a heat exchanger. Optionally, the method includes conveying the first heat transfer fluid through a coil and exchanging heat between the first heat transfer fluid in the first closed loop circuit and potable water in a potable water via the coil. Optionally, the method includes conveying the second heat transfer fluid through a coil and exchanging heat between the second heat transfer fluid in the second closed loop circuit and potable water in a potable water via the coil. Optionally, the method includes conveying the second heat transfer fluid through a compartment heat exchanger and exchanging heat between the second heat transfer fluid in the second closed loop circuit and the air in the compartment of the marine vessel via the compartment heat exchanger to thereby cool or heat the air in the compartment of the marine vessel.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

The present disclosure generally relates to thermal management systems for marine vessels. As discussed further below, these thermal management systems are operable to transfer thermal energy between components on the marine vessel by utilizing one or more fluids. For example, the thermal management systems of the present disclosure may advantageously transfer thermal energy between a cabin space, potable water heater, a drive system, and/or a body of water. It should be recognized that the fluids disclosed herein may be liquids, gases, or a combination of both. Note that 'thermal energy' and 'heat' are used interchangeably herein when describing the example thermal management systems of the present disclosure.

Figure 1:
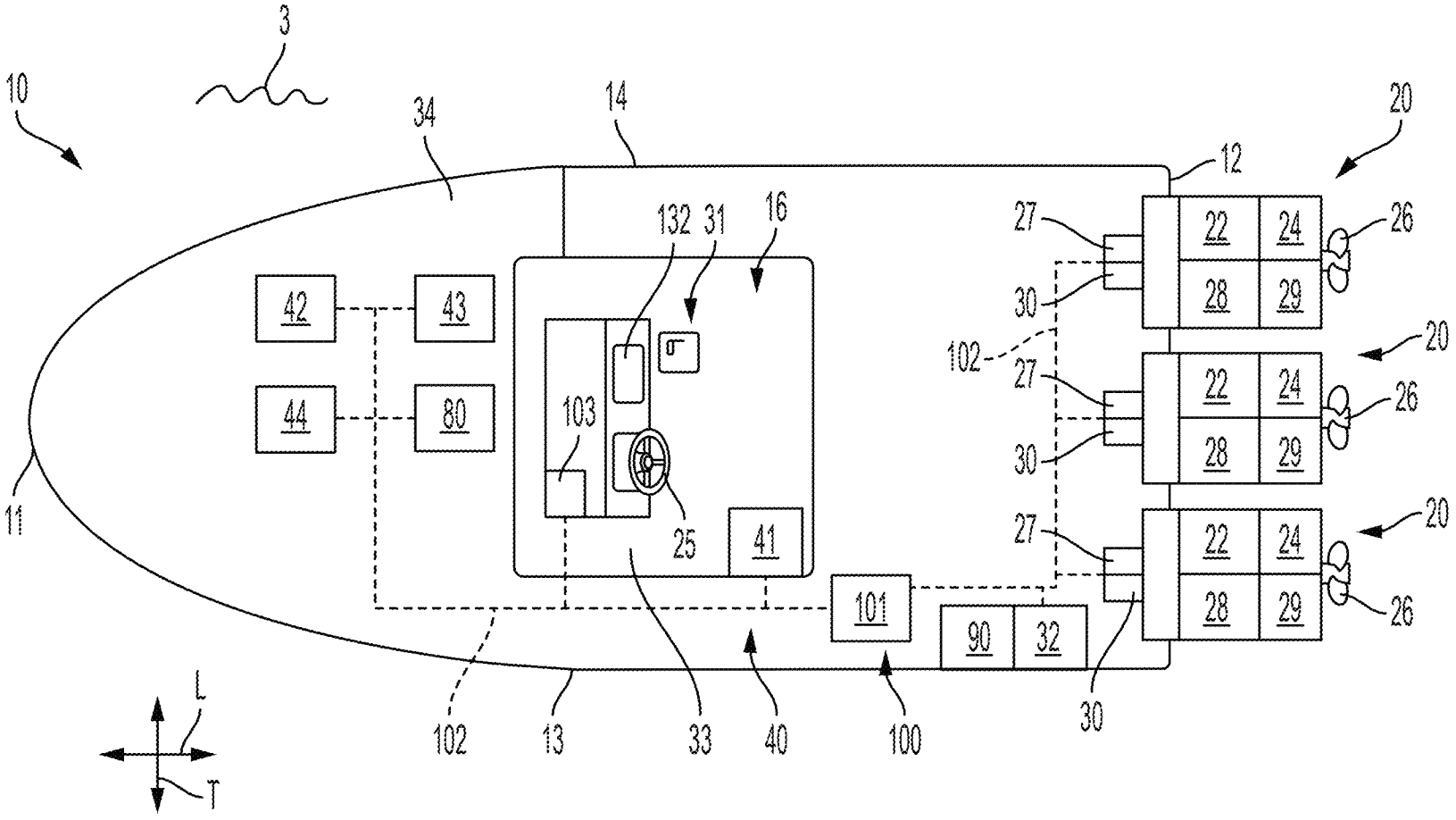
FIG. 1 is a schematic view of a marine vessel incorporating an example thermal management system according to the present disclosure.
Figure 2:
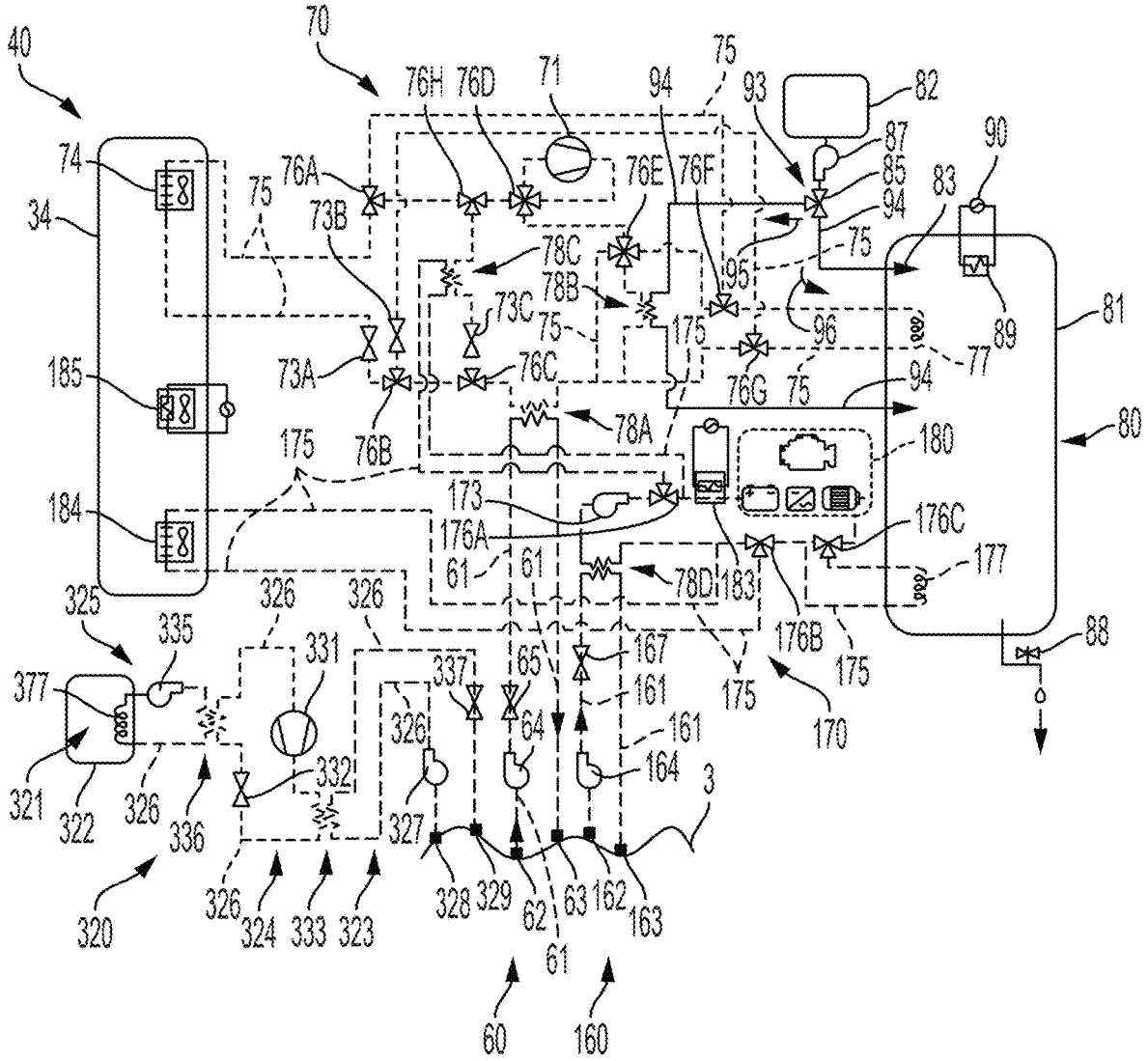
FIG. 2 is a schematic view of an example thermal management system according to the present disclosure.

FIGS. 1-2 depict an example thermal management system 40 for a marine vessel 10 according to the present disclosure. The marine vessel 10 longitudinally extends between a bow 11 and a stern 12 (see example longitudinal axis L) and transversely extends between a port side 13 and starboard side 14 (see example transverse axis T which is perpendicular to the longitudinal axis L). Note that the transverse axis T and the longitudinal axis L are each also perpendicular to a vertical axis (not depicted). The marine vessel 10 is propelled through a body of water 3 by marine propulsion devices 20, which while shown as outboard motors could also be inboard motors, stern drives, pod drives, and/or jet drives. Each marine propulsion device 20 includes a powerhead 22. The powerheads 22 can include internal combustion engines (e.g., gasoline or diesel engines), electric motors, and/or hybrids thereof. The powerhead 22 can include electrical power systems 32 in the case of electric or hybrid powerheads. The power system 32 may include batteries and/or other power storage devices, chargers, inverters (e.g., DC-AC inverters, AC-DC inverters), converters (e.g., DC-DC converters), and power distribution systems.

A propeller 26 is coupled in a torque-transmitting relationship with each powerhead 22 to generate propulsion in the water. The rotational engagement between the powerhead 22 and the propeller 26 is provided through a multi-speed transmission 28 and a gearset 29. The marine propulsion devices 20 further include one or more sensors 24 for sensing various characteristics of the marine propulsion devices 20 and/or the marine vessel 10 such as marine vessel speed and/or speed of the respective powerheads 22.

Steering actuators 27 are operable to steer the marine propulsion devices 20 in accordance with commands from a steering input device such as a steering wheel 25. The steering actuators 27 may be hydraulically, pneumatically, and/or electromechanically operated such as those discussed in U.S. Pat. Nos. 7,150,664; 7,255,616; and 7,467,595, which are hereby incorporated by reference in their entireties. Similarly, trim actuators 30 are operable to adjust a trim angle for each of the marine propulsion devices 20 in a manner known in the art. The trim actuators 30 may be hydraulically, pneumatically, and/or electromechanically operated such as those discussed in U.S. Pat. Nos. 7,156,709; 7,416,456; and 9,359,057, which are incorporated by reference herein.

With continued reference to FIG. 1, a central control module 101 (or CCM) is provided in signal communication with propulsion control modules 21 of the marine propulsion devices 20, as well as with other devices discussed herein. Although FIG. 1 shows one central control module 101, the present disclosure contemplates configurations in which multiple central control modules work together, serially and/or in parallel (e.g., providing a central control module for each marine propulsion devices 20). Likewise, it should be recognized that the communication links 102 shown to represent both communication and power connections are merely examples.

With continued reference to FIG. 1, the marine vessel 10 includes a helm 16 having a number of operator input devices for controlling various functions of the thermal management system 40 and the marine vessel 10 more generally. The operator input devices at the helm 16 include a multi-functional display device 132 including a user interface, such as an interactive, touch-capable display screen, a keypad, a display screen and keypad combination, and/or any other interfaces known in the art. By way of example, the display device 132 may be part of a VesselView® onboard management system by Mercury Marine Corporation of Fond du Lac, Wisconsin. The operator input devices further include one or more steering devices, such as the steering wheel and/or a joystick, configured to facilitate user input for steering the marine vessel 10 (e.g., via the central control module 101, the propulsion control modules 21, and/or a helm controller 103 in a manner known in the art). In certain examples, a throttle lever 31 is also provided as an operator input device for providing thrust commands to the central control module 101. Additional information relating to input devices and related control is provided in U.S. Pat. Nos. 9,248,898; 9,975,619; 9,994,296; and 10,594,510; which are incorporated by reference herein.

The helm 16 of the marine vessel 10 is positioned in a cockpit 33. In certain examples, the cockpit 33 is positioned adjacent or above a cabin 34. Various devices or systems 41-44, 80 are positioned within the cockpit 33 and/or within the cabin 34 that require heating and/or cooling depending on usage. Non-limiting examples of these devices or systems 41-44, 80 are identified herein below. For example, the marine vessel 10 has a HVAC system 41 for the cockpit 33, which requires heating when controlled to heat the air in the cockpit 33 and cooling when controlled to cool the air in the cockpit 33. The marine vessel 10 includes a second HVAC system 42 for the cabin 34, which like the HVAC system for the cockpit 33, requires heating when controlled to heat air in the cabin 34 and cooling when controlled to cool air in the cabin 34, a refrigerator 43 which only requires cooling (note that the refrigerator can also be referred to as being a heat "source"), a freezer 44 requiring only cooling, and/or a water heater 80 configured to require only heating (note that the water heater can also be referred to a heat "sink") to heat potable water therein. The devices or systems 41-44, 80 are selectively heated or cooled by the thermal management system 40 and may include other heat sources, heat sinks, or combinations thereof associated with the marine propulsion devices 20 or marine vessel 10. By way of example, these other components may include powerheads 22, multi-speed transmissions (not depicted), or portions of the power system 32.

FIG. 2 depicts the thermal management system 40 for sharing heating and cooling across one or more of the devices or systems, for example devices and systems 41-44, 80, of the marine vessel 10 according to the present disclosure in greater detail. The present inventors developed the example thermal management systems 40 of the present disclosure which may advantageously reduce the number of necessary components thereby reducing the space/footprint needed for the thermal management system 40 on the marine vessel 10 in comparison to conventional systems.

The system 40 includes a first open loop circuit 60 that extends via conduits 61 (depicted partially in dashed lines) between an inlet 62 and an outlet 63. The water inlet 62 is positioned to draw water from the body of water 3 in which the marine vessel 10 is operated into the first open loop circuit 60. The outlet 63 is positioned to return the water from the first open loop circuit 60 back to the body of water 3. The conduits 61 may be combinations of hoses, pipes, through-holes, and/or passages through certain components (such as heat exchangers as discussed below). In certain examples, the inlet 62 and/or the outlet 63 are formed in a gearcase of a marine propulsion device 20 or provided as a through-hole in the hull of the marine vessel 10 in a conventional manner.

A pump 64 is fluidly coupled to the first open loop circuit 60 and pumps the water from the body of water 3 into the inlet 62, through the first open loop circuit 60, and back to the body of water 3 via the outlet 63. Optionally, a valve 65 is coupled to the first open loop circuit 60 and is selectively opened to permit the water to be pumped through the first open loop circuit 60. As will be described in greater detail herein below, a first refrigeration component, such as a heat exchanger, is also coupled to the first open loop circuit 60.

The thermal management system 40 further includes a first closed loop circuit 70 formed by conduits 75 (depicted partially as dashed lines) through which a first heat transfer fluid is circulated. The first heat transfer fluid can be any suitable fluid such as water, a refrigerant used in air conditioning systems, a water-ethylene-glycol (WEG) mixture, or oil. The conduits 75 may be similar to the conduits 61 of the first open loop circuit 60.

The first closed loop circuit 70 is at least partially associated with one or more of systems (e.g., HVAC systems 41, 42) or devices (e.g., water heater 80) of the marine vessel 10, and therefore, the first closed loop circuit 70 is configured to facilitate transfer of heat between various compartment (e.g., the cockpit 33, the cabin 34), systems, and/or devices of the marine vessel 10.

One or more refrigeration components are coupled to the first closed loop circuit 70, and the refrigeration components may be any known refrigeration component such as a compressors 71, an evaporators, an expansion valves 73A-C, a heat exchanging device 74 (e.g., a condenser, a evaporator, a device that can act as a condenser or alternatively as an evaporator depending on the way the system is being operated), pumps, and/or one or more heat exchangers 78A-C (FIG. 2). In certain examples, the compressor 71 circulates the first heat transfer fluid through the first closed loop circuit 70. Optionally, a pump (not depicted) is fluidly coupled to the first closed loop circuit 70 and is configured to pump the first heat transfer fluid through the first closed loop circuit 70. In certain examples, the compressor 71 is a variable speed and/or variable direction refrigeration compressor. Example commercially available compressors which may be utilized with the thermal management systems 40 of the present disclosure are manufactured by several manufacturers such as Danfoss (e.g., Danfoss VZH, VSH, and VRJ inverter scroll compressors).

A refrigeration component, such as a first heat exchanger 78A, is configured to exchange heat between the first heat transfer fluid in the first closed loop circuit 70 and the water in the first open loop circuit 60. As such, the first heat transfer fluid in the first closed loop circuit 70 is cooled or heated and another refrigeration component, such as a heat exchanging device 74, is cooled or heated by the first heat transfer fluid and configured to cool or heat air within a compartment, such as the cabin 34 of the marine vessel 10 (note that the heat exchanging device 74 may act as an evaporator when it is removing heat from the air in the cabin 34 or a condenser when it is providing heat to the air in the cabin 34).

One or more valves 76A-H are coupled to the first closed loop circuit 70 and operable to selectively allow the first heat transfer fluid to flow through different sections of the first closed loop circuit 70. As such, the valves 76A-H are for selecting the path along which the first heat transfer fluid is conveyed and/or whether heat is exchanged between the first heat transfer fluid and different components and/or fluids in the thermal management system 40. The valves 76 can be any suitable valve such as a three-way valve, four-way valve, reversible flow valves, and/or the like.

The first closed loop circuit 70 is also configured to exchange heat between the first heat transfer fluid in the first closed loop circuit 70 and potable water in the water heater 80. The first closed loop circuit 70 extends through a coil 77 positioned in the water heater 80 (described in more detail herein). In this example, the first heat transfer fluid passes through the coil 77 such that heat transfers from the first heat transfer fluid to the potable water in the water heater 80. The valves 76A-I are operable to selectively allow the first heat transfer fluid to flow through the coil 77 or bypass the coil 77.

The water heater 80 is configured to receive heat from the first closed loop circuit 70 to thereby heat potable water in the water heater 80. The water heater 80 has a reservoir 81 which receives potable water from a potable water source, such as a storage tank 82, via an inlet 83. The potable water dispenses from the reservoir 81 via an outlet 84 to a use valve 88, such as a faucet. Optionally, a valve 85 is positioned between the storage tank 82 and the inlet 83. In certain examples, a pump 87 pumps the potable water from the storage tank 82 to the reservoir 81. In certain examples, the water heater 80 includes a positive temperature coefficient (PTC) heater 89 that receives power from a power source (e.g., power source 90 of the marine vessel 10) and is configured to optionally heat the potable water in the reservoir 81.

A second heat exchanger 78B configured to exchange heat between the first heat transfer fluid in the first closed loop circuit 70 and the potable water. Specifically, the first closed loop circuit 70 and a potable water circuit 93 (described herein) extend through the second heat exchanger 78B and accordingly, the second heat exchanger 78B is configured such that the first heat transfer fluid in the first closed loop circuit 70 transfers thermal energy (e.g., heats) the potable water in the potable water circuit 93 (described further herein). Note that additional information regarding conventional heat exchangers and conventional cooling circuits is provided in U.S. Pat. Nos. 5,004,042; 5,746,270; and 7,094,118, which are hereby incorporated by reference in their entireties.

Utilizing the second heat exchanger 78B as noted above advantageously reduces the risk of the first heat transfer fluid inadvertently contaminating the potable water in the water heater 80. In certain examples, the second heat exchanger 78B facilitates use of the waste heat from the first closed loop circuit 70 to heat the potable water in the case when the condensation temperature is higher than the incoming potable water temperature to the heat exchanger 78B, but lower than the hot water temperature in the hot water reservoir 81.

The potable water circuit 93 has one or more conduits 94 connecting the valve 85, the second heat exchanger 78B, and the reservoir 81. The valve 85 is configured to selectively prevent flow of the potable water from the storage tank 82 and/or allow potable water to flow to the first heat exchanger 78 such that the potable water is heated by the first heat transfer fluid in the first closed loop circuit 70. In one non-limiting example, the valve 85 is operated into a first position in which the potable water flows from the pump 87 along a first water path 95 through the conduits 94 to the second heat exchanger 78B. As such, the relatively cooler potable water from the storage tank 82 is pumped by the pump 87 to the second heat exchanger 78B where the first heat transfer fluid in the first closed loop circuit 70 heats the potable water. The heated potable water flows into the reservoir 81. Note that in certain examples, the second heat exchanger 78B is utilized with the certain example thermal management systems 40 when the heat needed to heat the potable water is greater than the temperature of the first heat transfer fluid in the first closed loop circuit 70 so that the potable water in the water heater 80 does not heat the first heat transfer fluid.

The valve 85 is operated to a second position in which the potable water flows from the pump 87 along a second water path 96 through the inlet 83 and into the reservoir 81. As such, relatively cooler potable water from the storage tank 82 is not heated in the first heat exchanger 78 and is instead pumped into the reservoir 81.

The valve 85 can also be operated to a third position in which the potable water circulates along a third water path which comprises portions of the first and second water paths 95, 96 such that potable water in the reservoir 81 circulates through the first heat exchanger 78 by way of convection. As such, no new, relatively cooler potable water enters the reservoir 81. The water in the reservoir 81 is maintained at a threshold temperature. The valve 85 can be further operated to a fourth position in which the potable water remains in the reservoir 81 (e.g., the potable water does not circulate through the first heat exchanger 78 and the potable water from the storage tank 82 does not enter the reservoir 81).

In certain examples, a heater, such as a PTC heater 185 or propane heater, is configured to heat the air in the cabin 34. The PTC heater 89 receives power from a power source (e.g., power source 90 of the marine vessel).

The system 40 depicted in FIG. 2 also includes one or more additional open loop circuits and/or closed loop circuits for exchanging heat with one or more systems and/or components of the marine vessel 10.

The thermal management system 40 further includes a second closed loop circuit 170 formed by conduits 175 (depicted as dashed lines) through which a second heat transfer fluid is circulated. The second heat transfer fluid can be any suitable fluid such as water, a refrigerant used in air conditioning systems, a water-ethylene-glycol (WEG) mixture, or oil. The conduits 175 may be similar to the conduits 75 of the first closed loop circuit 70.

A pump 173 is fluidly coupled to the second closed loop circuit 170 and is configured to pump the second heat transfer fluid through the second closed loop circuit 170.

The second closed loop circuit 170 is at least partially associated with one or more drive systems 180 (e.g., an internal combustion engine drive system, an electric drive or motor system, a hybrid drive system comprising an internal combustion engine and an electric drive or motor) of the marine vessel 10 and therefore the second closed loop circuit 170 is configured to facilitate cooling or heating of the drive systems 180. Note that in certain examples the drive system 180 is part of and/or coupled to the power system 32 (FIG. 1) and/or the propulsion devices 20 of the marine vessel 10. The drive system 180 can include one or more components such as an internal combustion engine, an electric motor, a battery, a battery charger, a DC-DC converter, and/or the like. The components of the drive system 180 may define one or more passageways through which the second heat transfer fluid in the second closed loop circuit 170 flows.

One or more valves 176A-C are coupled to the second closed loop circuit 170 and operable to selectively allow the second heat transfer fluid to flow through different sections of the second closed loop circuit 170. As such, the valves 176A-C are for selecting whether heat is exchanged between the second heat transfer fluid and different components and/or fluids in the thermal management system 40. The valves 176A-C can be any suitable valve such as a three-way valve, four-way valve, reversible flow valve, and/or the like.

The second closed loop circuit 170 also extends through a third heat exchanger 78C, and the first closed loop circuit 70 also extends through the third heat exchanger 78C. As such, the third heat exchanger 78C is configured to exchange heat between the first heat transfer fluid in the first closed loop circuit 70 and the second heat transfer fluid in the second closed loop circuit 170. In certain examples, the second heat transfer fluid in the second closed loop circuit 170 is circulated to heat or cool one or more components of the drive system 180, as needed.

In certain examples, the second closed loop circuit 170 may be particularly advantageous for warming a component of the drive system 180, such as a battery, early in the operation of the drive system 180 and/or for operation of the drive system 180 in cold temperatures. For instance, the second closed loop circuit 170 may transfer heat from the potable water in the water heater 80 to the component(s) of the drive system 180. It should also be recognized that if the thermal management system 40 determines that the component (e.g., battery) of the component of the drive system 180 no longer needs to be heated, one or more valves 176A-C may be closed to prevent further heating via the second heat transfer fluid in the second closed loop circuit 170 and/the pump 173 is turned off.

In certain examples, a PTC heater 183 is configured to heat the second heat transfer fluid in the second closed loop circuit 170 for warming one or more components of the drive system 180. The PTC heater 89 receives power from a power source (e.g., power source 90 of the marine vessel 10). In certain examples, the drive system 180 includes components that are only heat sources, such as powerheads and transmissions, of the drive system 180. In certain instances, the valves 176A-C may be operated such that the second heat transfer fluid flows through the component(s) of the drive system 180 only when the temperature of the second heat transfer fluid is less than the temperature of the component(s) of the drive system 180.

The second closed loop circuit 170 is also configured to exchange heat between the second heat transfer fluid in the second closed loop circuit 170 and potable water in the water heater 80. In one example, the second closed loop circuit 170 extends through a coil 177 positioned in the water heater 80. As such, the second heat transfer fluid passes through the coil 177 and heat transfers between the second heat transfer fluid and the potable water in the water heater 80. The valve 176C operates to selectively allow the second heat transfer fluid to flow through the coil 177 or bypass the coil 177. As such, the valve 176 is for selecting whether heat is exchanged between the second heat transfer fluid and the potable water in the water heater 80 or the second heat transfer fluid bypasses the water heater 80.

The second closed loop circuit 170 is also configured to exchange heat between the second heat transfer fluid in the second closed loop circuit 170 and a refrigeration component, for example a compartment heat exchanger 184, which is coupled to the second closed loop circuit 170. In the example depicted in FIG. 2, the second heat transfer fluid in the second closed loop circuit 170 cools or heats the compartment heat exchanger 184 and accordingly, the compartment heat exchanger 184 cools or heats air within a compartment, such as the cabin 34, of the marine vessel 10.

The second closed loop circuit 170 also extends through a fourth heat exchanger 78D. A second open loop circuit 160 (described further herein) extends through the fourth heat exchanger, and the fourth heat exchanger 78D is configured to exchange heat between the second heat transfer fluid in the second closed loop circuit 170 and the water in the second open loop circuit 160.

The system 40 includes a second open loop circuit 160 configured to exchange heat between the water in the second open loop circuit 160 and the second heat transfer fluid in the second closed loop circuit 170. The second open loop circuit 160 extends via conduits 161 (depicted as dashed lines) between an inlet 162 and an outlet 163. The inlet 162 is positioned to draw water from the body of water 3 in which the marine vessel 10 is operated into the second open loop circuit 160.

The outlet 163 is positioned to return the water from the second open loop circuit 160 back to the body of water 3. The conduits 161 may be combinations of hoses, pipes, through-holes, and/or passages through certain components (such as the fourth heat exchanger 78D). In certain examples, the water inlet 162 and/or the water outlet 163 are formed in a gearcase of a marine propulsion device 20 or provided as a through-hole in a hull of the marine vessel 10 in a conventional manner.

A pump 164 is fluidly coupled to the second open loop circuit 160 and pumps the water from the body of water 3 into the inlet 162, through the second open loop circuit 160, and back to the body of water 3 via the outlet 163. Optionally, a valve 167 is coupled to the second open loop circuit 160 and is selectively opened to permit the water to be pumped through the second open loop circuit 160. As noted above, heat is transferred between the water in the second open loop circuit 160 and the second heat transfer fluid in the second closed loop circuit 170 via the fourth heat exchanger 78D. Note in certain examples, the pump 164 is a bi-directional pump such that water is pumped in through the water outlet 163, through the second open loop circuit 160, and back to the body of water 3 via the water inlet 162.

In certain examples, the water conveyed through the second open loop circuit 160 is configured to be conveyed in a similar manner as the water conveyed through the first open loop circuit 60 discussed above. In certain examples, rather than having a distinct inlet, outlet, and pump, the first open loop circuit 60, the second open loop circuit 160, and/or a refrigeration open loop circuit 323 (Described herein) are fluidly coupled to one another such that the water is received via the inlet and returned via the outlet. In certain examples, the same pump 64 discussed above is also used to pump the water the second open loop circuit 160 and/or a refrigeration open loop circuit 323.

In certain examples, the thermal management system 40 includes a 'frost box' or refrigeration system 320 which defines a refrigeration space 321 within an insulated or uninsulated enclosure 322. The refrigeration system 320 is configured to cool the air within the refrigeration space 321 and thereby items (e.g., fish, bait, food, beverage) stored in the enclosure 322. The refrigeration system 320 includes a refrigeration open loop circuit 323, a first refrigeration closed loop circuit 324, and/or a second refrigeration closed loop circuit 325. The circuits 323, 324, 325 are at least partially defined by conduits 326 (depicted in dashed lines) which are similar to the other conduits described herein.

A pump 327 pumps water through the refrigeration open loop circuit 323 from the body of water 3 into the inlet 328, through the refrigeration open loop circuit 323, and back to the body of water 3 via the outlet 329. Optionally, a valve 337 is coupled to the refrigeration open loop circuit 323 and is selectively opened to permit the water to be pumped through the refrigeration open loop circuit 323.

The first refrigeration closed loop circuit 324 includes one or more refrigeration components, for example expansion valve 330 and a compressor 331. The compressor 331 circulates a heat transfer fluid through the first refrigeration closed loop circuit 324. Optionally, a pump (not depicted) is fluidly coupled to the first refrigeration closed loop circuit 324 and is configured to pump the heat transfer fluid through the first refrigeration closed loop circuit 324.

Another refrigeration component, such as a heat exchanger 333, is configured to exchange heat between the heat transfer fluid in the first refrigeration closed loop circuit 324 and the water in the refrigeration open loop circuit 323. As such, the heat transfer fluid in the first refrigeration closed loop circuit 324 is cooled (or heated).

The second refrigeration closed loop circuit 325 includes one or more refrigeration components, for example pump 335. The pump 335 circulates a heat transfer fluid through the second refrigeration closed loop circuit 325.

Another refrigeration component, such as a heat exchanger 336, is configured to exchange heat between the heat transfer fluid in the second refrigeration closed loop circuit 325 and the heat transfer fluid in the first refrigeration closed loop circuit 324. As such, the heat transfer fluid in the second refrigeration closed loop circuit 325 is cooled (or heated) by the heat transfer fluid in the first refrigeration closed loop circuit 324. Note that in certain examples, the first and second refrigeration loops are combined into a single closed loop circuit. In these examples, one of the heat exchangers (as depicted in FIG. 2) can be eliminated. A coil 377 through which the heat transfer fluid is conveyed is in the refrigeration space 321 and heat is transferred between the refrigeration space 321 and the heat transfer fluid via the coil 377.

Note that any of the circuits and/or the components of the system 40 can be operated in a heat pump mode, and accordingly, it should be understood that the circuits and/or the components of the system 40 described herein may be modified (e.g., change in direction of fluid flow through one or more circuits) to accommodate heat pump modes and the description of the circuits and/or the components of the system 40 should not be limited to the specific description of these circuits and/or the components set forth herein. For example, the pump 164 of the second open loop circuit 160 may be operated in reverse such that the water is drawn in through the outlet 163 and dispensed out through the inlet 162. In this example, the water in the second open loop circuit 160 transfers heat to the second heat transfer fluid in the second closed loop circuit 170 via the fourth heat exchanger 78D.

In certain examples, the thermal management systems 40 may operate any of the components, such as the valves 76A-H, the pumps 64, 164, 87, 173, and heat exchangers 78A-D, based on signals from one or more temperature sensors, such as temperature sensors 50 that sense temperatures of fluids or components in or related to thermal management systems 40. The temperature sensors 50 may be of a type presently known in the art. In certain examples, the thermal management system 40 may also control the heating or cooling of the circuits 60, 70, 93, 160, 170, 190 via control of the valves 76A-H and/or changing flow rates via the pumps, such as pumps 64, 164, 87, 173, or other methods discussed herein. In one non-limiting example, the temperature sensor 50 senses the temperature of the second heat transfer fluid in the second closed loop circuit 170 and sends corresponding signals to the control system 100. The control system 100 compares the sensed temperature to a threshold temperature and determines if one or more valves 176A-C should be operated to a different position and/or the operation of the pump 173 should be modified to change the flow direction and/or rate of the second heat transfer fluid.

Figure 3:
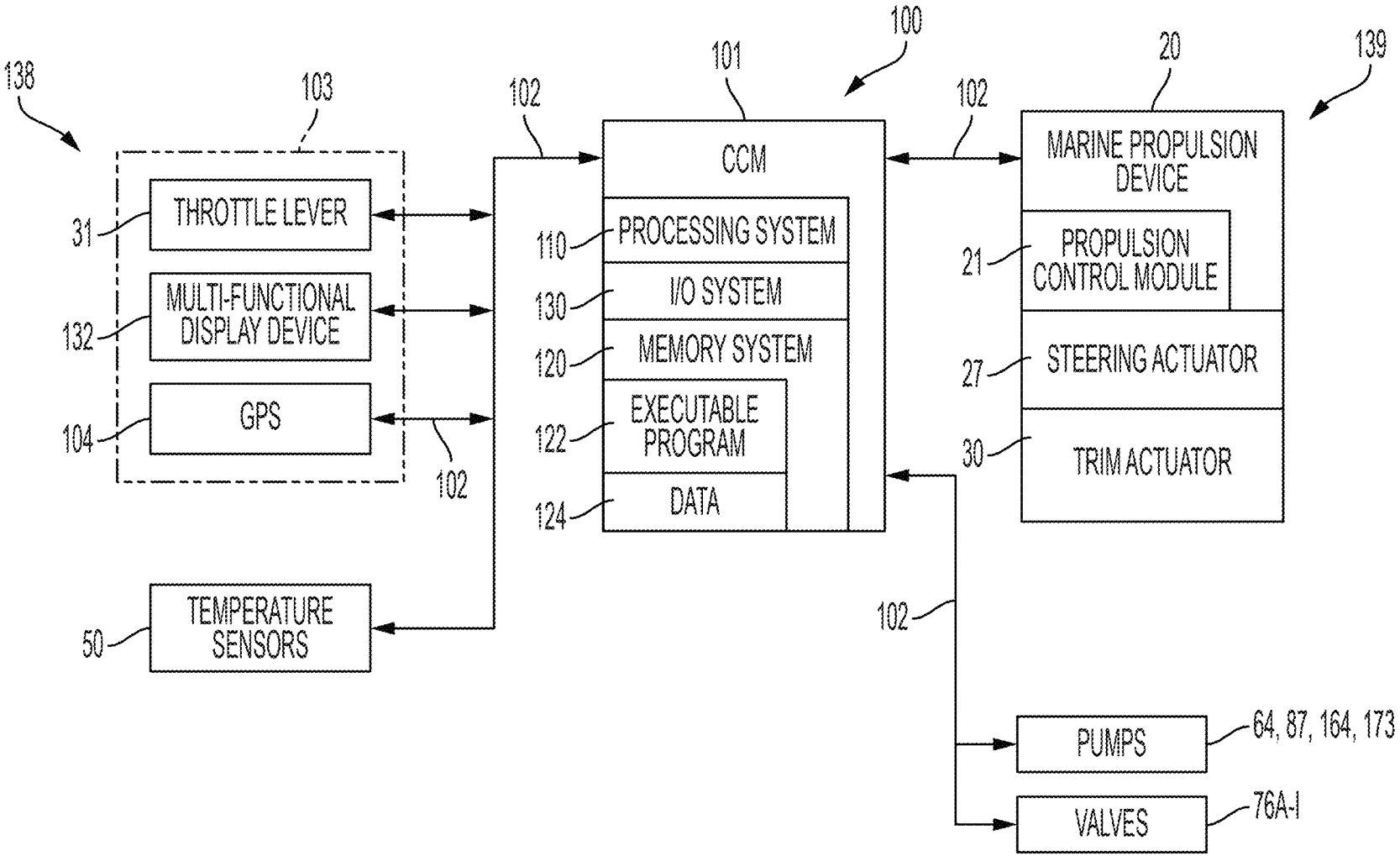
FIG. 3 is a schematic view of an example control system according to the present disclosure.

The systems 40 of the present disclosure include a control system 100, exemplarily depicted in FIG. 3. The control system 100 includes one or more central control modules 101, one or more propulsion control modules 21, the helm controller 103, and/or other controllers of the marine vessel 10. A person of ordinary skill in the art will recognize that these subsystems may also be present within additional central control modules 101 (as applicable) and/or propulsion control modules 21 or other controllers within the marine vessel 10. In the example shown, the central control module 101 includes a processing system 110, which may be implemented as a single microprocessor or other circuitry or be distributed across multiple processing devices or subsystems that cooperate to execute the executable program 122 from a memory system 120 of the central control module 101. Non-limiting examples of the processing system include general purpose central processing units, application specific processors, and logic devices.

Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

The memory system 120 may comprise any storage media readable by the processing system 110 and capable of storing the executable program 122 and/or data 124. The memory system 120 may be implemented as a single storage device or be distributed across multiple storage devices or sub-systems that cooperate to store computer readable instructions, data structures, program modules, or other data. The memory system 120 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example. An input/output (I/O) system 130 provides communication between the control system 100 and peripheral devices, such as input devices 138 and output devices 139, which are discussed further below. The IO system 130 communicates via wires and/or wirelessly via input devices 138 and/or output devices 139, or with other elements of the control system 100. In practice, the processing system 110 loads and executes an executable program 122 from the memory system 120, accesses data 124 stored within the memory system 120, and directs the thermal management system 40 to operate as described in further detail below.

A person of ordinary skill in the art will recognize that these subsystems within the control system 100 may be implemented in hardware and/or software that carries out a programmed set of instructions. As used herein, the term "central control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A central control module may include memory (shared, dedicated, or group) that stores code executed by the processing system. The term "code" may include software, firmware, and/or microcode, and may refer to programs, routines, functions, classes, and/or objects. The term "shared" means that some or all code from multiple central control modules may be executed using a single (shared) processor. In addition, some or all code from multiple central control modules may be stored by a single (shared) memory. The term "group" means that some or all code from a single central control module may be executed using a group of processors. In addition, some or all code from a single central control module may be stored using a group of memories. One or more central control module may together constitute a control system 100 and may be located anywhere on the marine vessel 10.

A person of ordinary skill in the art will understand in light of the disclosure that the control system 100 may include a differing set of one or more control modules, or control devices, which may include engine control modules (ECMs) or propulsion control modules 21 for each marine propulsion device 20 (which, when applicable, may be referred to as ECMs even if the marine propulsion device 20 contains an electric motor in addition to or in place of an internal combustion engine), one or more thrust vector control modules (TVMs), one or more helm control modules (HCMs), and/or the like. Likewise, certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices.

The control system 100 communicates with each of the one or more components of the marine vessel 10 via a communication link 102, which can be any wired or wireless link. The illustrated communication link 102 connections between functional and logical block components are merely exemplary, which may be direct or indirect, and may follow alternate pathways. The control system 100 is capable of receiving information and/or controlling one or more operational characteristics of the marine vessel 10 and its various sub-systems by sending and receiving control signals via the communication links 102. In one example, the communication link 102 is a controller area network (CAN) bus; however, other types of links could be used. It will be recognized that the extent of connections and the communication links 102 may in fact be one or more shared connections, or links, among some or all of the components in the marine vessel 10. Moreover, the communication link 102 lines are meant only to demonstrate that the various control elements are capable of communicating with one another, and do not represent actual wiring connections between the various elements, nor do they represent the only paths of communication between the elements. Additionally, the marine vessel 10 may incorporate various types of communication devices and systems, and thus the illustrated communication links 102 may in fact represent various different types of wireless and/or wired data communication systems.

The control system 100 is configured to communicate with input devices 138 from various components such as sensors incorporated into the throttle lever 31 and/or a steering device. The control system 100 also communicates with other input devices 138, such as the multi-functional display device 132, the GPS 104, and the temperature sensors 50.

The control system 100 also communicates with output devices 139 such as propulsion control modules 21 of the marine propulsion devices 20, the steering actuators 27 (and steering angle sensors associated therewith), and the trim actuators 30 (and trim angle sensors associated therewith), as well as any of the pumps (e.g., pumps 64, 164, 87, 173) and valves (e.g., vales 76A-I) described herein. It will be recognized that the arrows shown are merely exemplary and that communication may flow in multiple directions. For example, the multi-functional display device 132 may serve as both the input device 138 for the operator to provide commands and the output device 139 to display information transmitted from the central control module 101.

Figure 4:
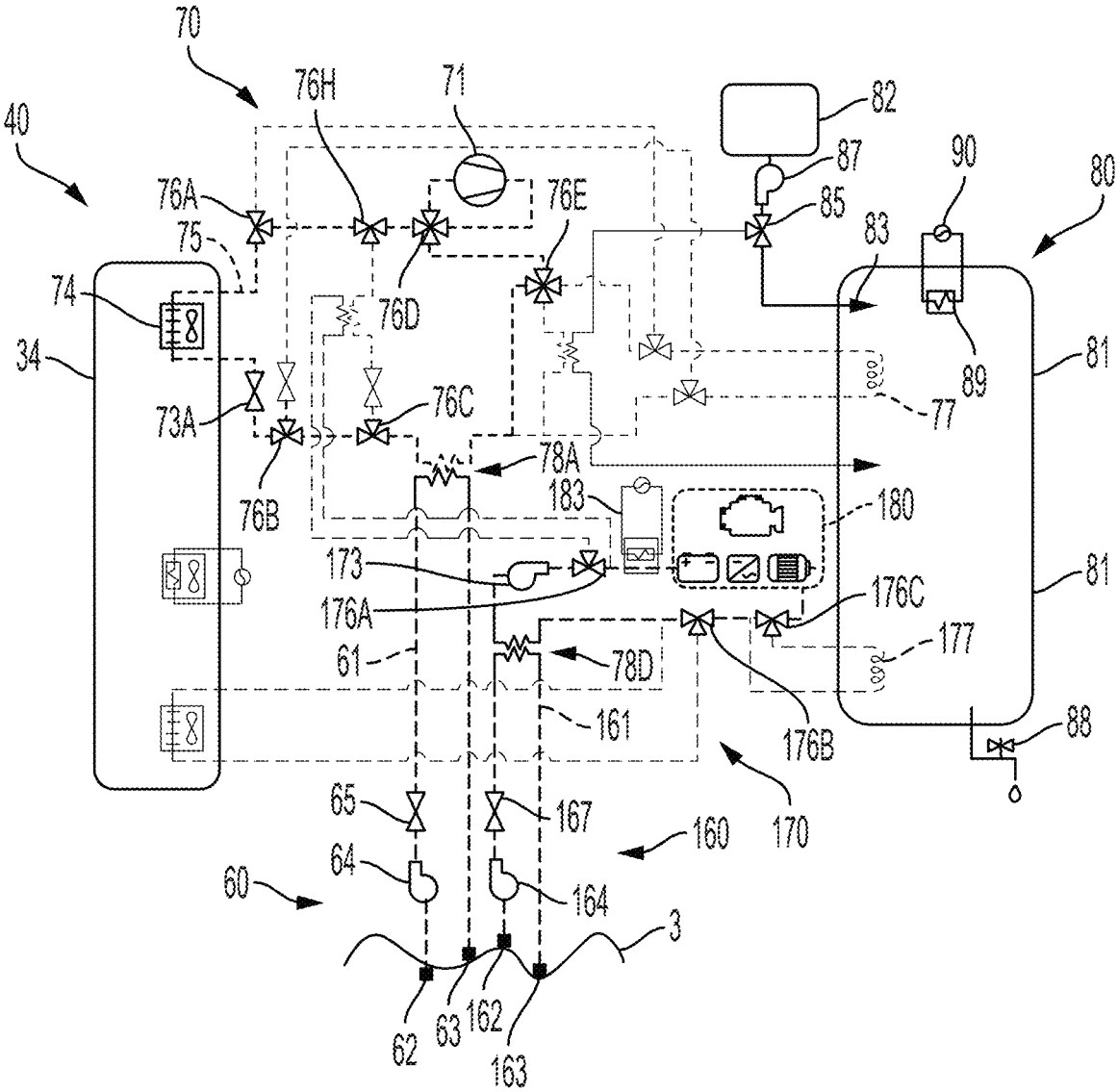
FIGS. 4, 6, 8, 10, 12, 14, 16-19, and 21-23 are schematic views of example thermal management systems according to the present disclosure.

FIGS. 4-23 depicts various operational modes and/or methods of operating the example thermal management systems 40 of the present disclosure. An example schematic view of the thermal management system 40 for the example operational modes described below is provided and the schematic view of the thermal management system 40 for each operational mode may be similar to the schematic view of the thermal management system 40 depicted in FIG. 2. Note that in order to draw attention to certain components for a specific example operational mode, certain components of the thermal management system 40 are depicted in gray lines (as compared to other components depicted in black lines). The visual distinction between components depicted in gray lines should not be interpreted as eliminating/excluding the components from the thermal management system 40, but rather the components depicted in gray lines are simply not described in detail or active for the specific operational mode. For instance, FIG. 4 depicts both coils 77, 177 and PTC heater 183 in gray lines and as the second heat transfer fluid is not being actively pumped through the coils 77, 177 and the PTC heater is 'off' when the thermal management system 40 is operating in the first operational mode described below with reference to FIG. 4.

The example methods are described below for the thermal management system 40 as a series of logic steps, the effects of which may be already discussed above with respect to FIGS. 1-3. The example methods can include certain logic steps relative to the operational modes described herein. Note that while certain methods described below refer to one or more example operational modes of the thermal management system 40, it should be understood that one or more steps from any of methods may be incorporated into any other method. Furthermore, the present disclosure contemplates that any combination of individual or multiple steps from any of the methods described herein below may be applicable and/or utilized by any example thermal management systems 40 of the present disclosure and the present disclosure is not limited to the specific combination of steps set forth below in each other example methods.

Further note that each of the example thermal management systems 40 described herein can include one or more features and/or components of other example thermal management systems 40 described herein. In addition, the example operational modes described herein can include one or more features and/or components from other example operational modes and/or descriptions provided herein. Note that components indicated in thermal management systems 40 depicted in FIGS. 2, 4, 6, 8, 10, 12 14 16-19, and 21-23 are denoted with the same part numbers, however, it should be understood that the use of the same part numbers for systems and/or components of the present disclosure should not be construed to indicate that the similarly marked systems and/or components are necessarily identical. The similarly marked systems and/or components may have varying features or characteristics. For instance, the storage tank 82 of FIG. 2 may be configured to have a different capacity and/or the like relative to the storage tank 82 of FIG. 14.

It should also be recognized that the thermal management systems 40 of the present disclosure advantageously provide for customization and scalability for heating and cooling other components of the marine vessel 10. For example, the components (e.g., water heater) or the systems (e.g., engine drive system) shown in FIGS. 1-2 may be substituted for other components requiring heating or cooling (e.g., cooking appliances). Likewise, additional components may be fluidly connected within the circuits depicted in FIG. 1-2.

Additional details and features of the example thermal management systems 40 of the present disclosure, including example control and operational features of components thereof, are described herein below. The details and features described below may be incorporated into any example thermal management systems 40 of the present disclosure.

FIG. 4 depicts the thermal management system 40 in a first operational mode. The first operational mode is advantageously utilized during warm weather or summer days. In this first operational mode, the pump 64 pumps relatively cooler water from the body of water 3 through the first open loop circuit 60 to the first heat exchanger 78A. The first heat exchanger 78A is configured to exchange heat between the water and the first heat transfer fluid in the first closed loop circuit 70 thereby warming the water in the first open loop circuit. The warmed water is dispensed from the first open loop circuit 60 back into the body of water 3, and the body of water 3 acts as a heat sink.

The first heat transfer fluid in the first closed loop circuit 70 is cooled as thermal energy transfers from the first heat transfer fluid to the water, and the first heat transfer fluid flows to and cools a refrigeration component, e.g., the heat exchanging device 74, positioned in the cabin 34. The heat exchanging device 74 cools the air in the cabin 34 and/or the first heat transfer fluid absorbs heat from the air in the cabin 34 via the heat exchanging device 74. As such, the air in the cabin 34 is cooled to a comfortable temperature for the occupants compared to the relatively warmer air outside of the marine vessel 10.

The compressor 71 causes the first heat transfer fluid to be conveyed through the first closed loop circuit 70 and the expansion valve 73A. The control system 100 controls one or more valves 76A-I to facilitate flow of the first heat transfer fluid through the first closed loop circuit 70 as noted above.

The pump 87 pumps the potable water from the storage tank 82 through the valve 85 to the reservoir 81, and the PTC heater 89 heats the potable water in the reservoir 81. Note that the coils 77, 177 are depicted in gray lines as the first heat transfer fluid and the second heat transfer fluid, respectively, are not conveyed through the coils 77, 177.

The pump 164 pumps relatively cooler water from the body of water 3 through the second open loop circuit 160 to the fourth heat exchanger 78D. The fourth heat exchanger 78D is configured to exchange heat between the water and the second heat transfer fluid in the second closed loop circuit 170 thereby warming the water in the second open loop circuit. The warmed water is dispensed from the second open loop circuit 160 back into the body of water 3, and the body of water 3 acts as a heat sink.

The second heat transfer fluid in the second closed loop circuit 170 is cooled as thermal energy transfers from the second heat transfer fluid to the water, and the second heat transfer fluid flows to and cools one or more components of the drive system 180. As such, the one or more components of the drive system 180 are cooled to a second threshold temperature (described herein).

The pump 173 pumps the second heat transfer fluid through the second closed loop circuit 170. The control system 100 controls several valves 176A-C to facilitate flow of the second heat transfer fluid through the second closed loop circuit 170.

Figure 5:
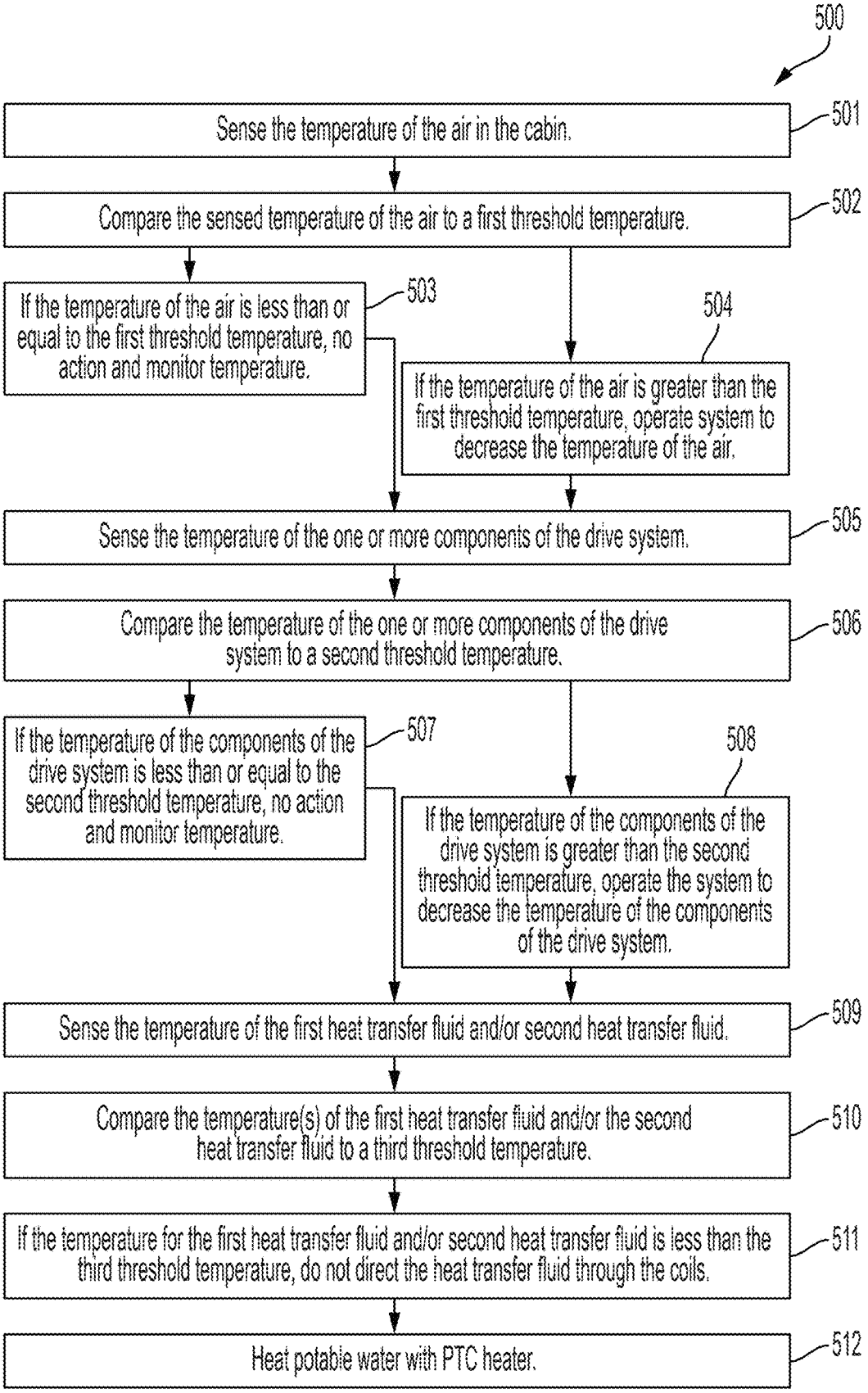
FIGS. 5, 7, 9, 11, 13, 15, and 20 are flow charts depicting example methods for operating example thermal management systems of the present disclosure.

FIG. 5 depicts an example method 500 for operating the thermal management system 40 in the first operational mode according to the present disclosure with reference to FIGS. 2 and 4. The method 500 begins at step 501 with a first temperature sensor 50 (FIG. 3) sensing the temperature of the air in the cabin 34. The control system 100 receives signals from the temperature sensor 50 corresponding to the sensed temperature of the air in the cabin 34 and other temperature sensors 50 noted herein in this example method 500. The control system 100 compares, at step 502, the sensed temperature of the air in the cabin 34 to a first threshold temperature (e.g., the first threshold temperature is based on an algorithm, acceptable temperature range, temperature value in a look-up table). For example, the first threshold temperature is a maximum temperature predetermined by the occupants of the marine vessel for air in the cabin 34 (e.g., 20.0 degrees Celsius).

If the control system 100 determines, at step 503, that the sensed temperature of the air in the cabin 34 is less than or equal to the first threshold temperature, the control system 100 does not send any immediate action control signals to other components of the system 40 and the control system 100 continuously monitors the sensed temperature of the air in the cabin 34.

However, if the control system 100 determines, at step 504 that the sensed temperature of the air in the cabin 34 is greater than the first threshold temperature, the control system 100 is configured to facilitate control of other components in the system 40 to thereby decrease the temperature of the air in the cabin 34. For example, the control system 100 operates the pump 64, the compressor 71, and/or the controls one or more valves 76A-H such that heat is transferred from the air in the cabin 34 through the heat exchanging device 74, the first closed loop circuit 70, and the first open loop circuit 60 to the body of water 3 (e.g., the body of water 3 acts as a heat sink for the excess heat removed from the air in the cabin 34)

At step 505, a second temperature sensor 50 senses the temperature of the one or more components of the drive system 180. The control system 100 compares, at step 506, the sensed temperature of the one or more components of the drive system 180 or the second heat transfer fluid to a second threshold temperature (e.g., the second threshold temperature may correspond to the ideal temperature range for the power source 90 is between 30.0 degrees Celsius and 50.0 degrees, the second threshold temperature may correspond to the minimum temperature of the second heat transfer fluid which for example may be 20.0 degrees Celsius). Note that in certain examples the second threshold temperature is based on an algorithm, acceptable temperature range, temperature value in a look-up table. In one non-limiting example, the second threshold temperature is a maximum temperature of the one or more components of the drive system 180 (e.g., the second threshold temperature is greater than the first threshold temperature, the second threshold temperature is the maximum temperature to avoid improper operation of the components of the drive system 180).

If the control system 100 determines, at step 507, that the sensed temperature of the components of the drive system 180 is less than or equal to the second threshold temperature, the control system 100 does not send any immediate action control signals to other components of the system 40 and the control system 100 continuously monitors the sensed temperature of the components of the drive system 180.

However, if the control system 100 determines, at step 508 that the sensed temperature of the components of the drive system 180 is greater than the second threshold temperature, the control system 100 is configured to facilitate control of other components in the system 40 to thereby decrease the temperature of the components of the drive system 180. For example, the control system 100 operates the pump 173 and/or the valves 176A-C such that the second heat transfer fluid is conveyed through the second closed loop circuit 170 to cool the components of the drive system 180. The control system 100 also operates the pump 164 to pump relatively cooler water from the body of water 3 through the second open loop circuit 160 such that heat is transferred from the second heat transfer fluid in the second closed loop circuit 170 to the water in the second open loop circuit 160 via the fourth heat exchanger 78D. The heated water in the second open loop circuit 160 is returned to the body of water 3 (e.g., the body of water 3 acts as a heat sink for the excess heat removed from the components of the drive system 180).

At step 509, a third temperature sensor 50 senses the temperature of the first heat transfer fluid in the first closed loop circuit 70 and/or a fourth temperature sensor 50 senses the temperature of the second heat transfer fluid in the second closed loop circuit 170. The control system 100 compares, at step 510, the sensed temperature(s) of the first heat transfer fluid and/or the second heat transfer fluid, independently to a third threshold temperature (e.g., the third threshold temperature is equal to or greater than 50.0 degrees Celsius, the third threshold temperature is equal to or greater than 60.0 degrees Celsius). Note that in certain examples the third threshold temperature is based on an algorithm, acceptable temperature range, temperature value in a look-up table. In one non-limiting example, the third threshold temperature is a minimum acceptable temperature of the potable water in the reservoir 81 (e.g., the third threshold temperature is greater than the second threshold temperature).

At step 511, if the sensed temperature for the first heat transfer fluid is less than the third threshold temperature, the control system 100 determines that there is insufficient heat in the first heat transfer fluid to increase the temperature of the potable water in the water heater 80. Thus, the control system 100 controls one or more valves 76A-H such that the first heat transfer fluid does not flow through the coil 77. Similarly, if the sensed temperature for the second heat transfer fluid is less than the third threshold temperature, the control system 100 determines that there is insufficient heat in the second heat transfer fluid to increase the temperature of the potable water in the water heater 80. Thus, the control system 100 controls one or more valves 176A-C such that the second heat transfer fluid does not flow through the coil 177.

The control system 100, at step 512, sends control signals to the PTC heater 89 to generate heat that thereby heats the potable water in the water heater 80. The PTC heater 89 uses electrical energy from the power source 90 to heat the potable water, and the control system 100 continues to operate the PTC heater 89 until the sensed temperature of the potable water increases to or above the third threshold temperature. Note that the control system 100 can also monitor the temperature of the potable water. If the control system 100 determines that the temperature of the potable water is above the third threshold temperature, the control system 100 may prevent or cease operation of the PTC heater 89.

Figure 6:
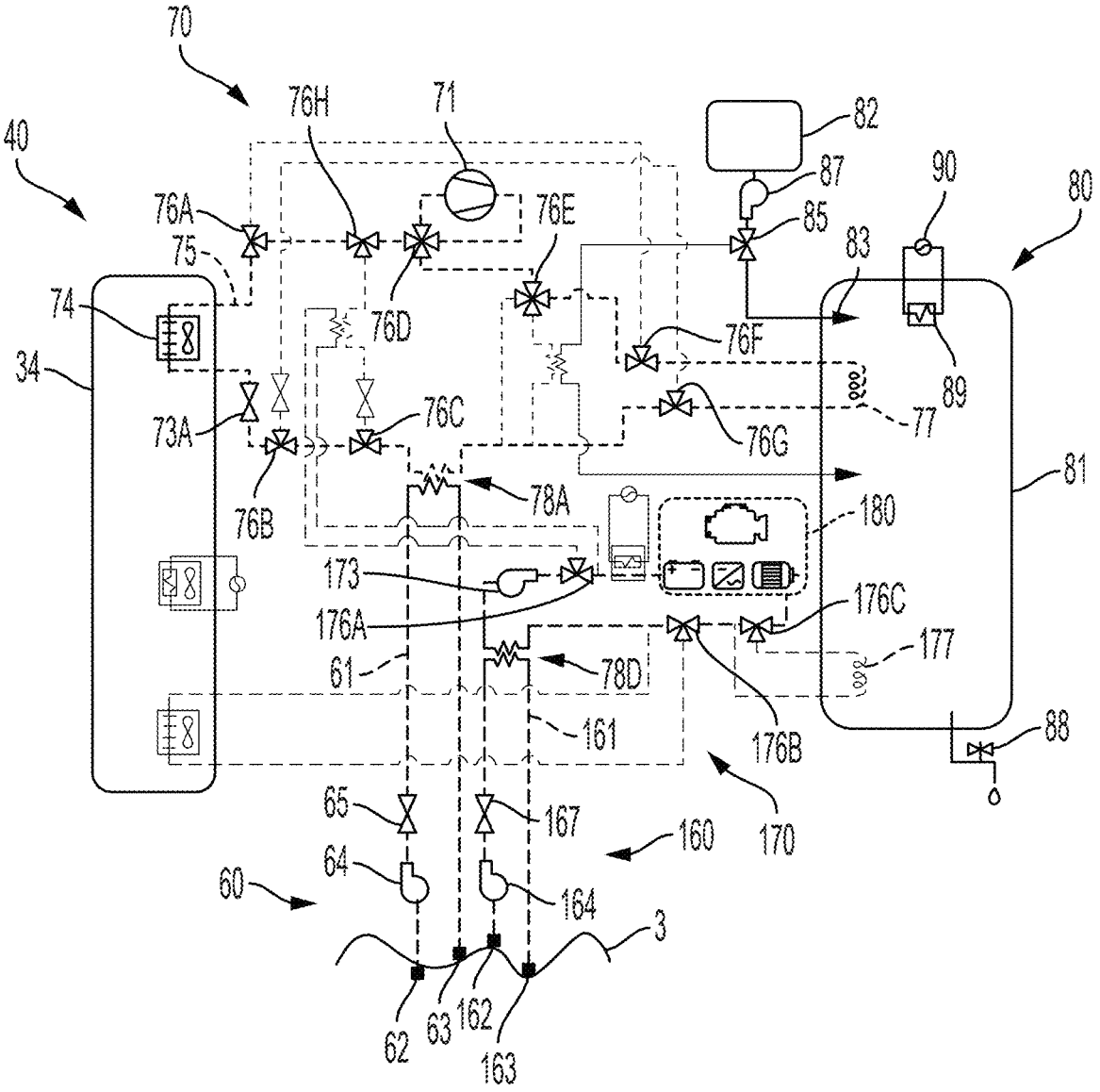

FIG. 6 depicts the thermal management system 40 in a second operational mode. The second operational mode is advantageously utilized during warm weather or summer days. In this second operational mode, the pump 64 pumps relatively cooler water from the body of water 3 through the first open loop circuit 60 to the first heat exchanger 78A. The first heat exchanger 78A is configured to exchange heat between the water and the first heat transfer fluid in the first closed loop circuit 70 thereby warming the water in the first open loop circuit. The warmed water is dispensed from the first open loop circuit 60 back into the body of water 3, and the body of water 3 acts as a heat sink.

The first heat transfer fluid in the first closed loop circuit 70 is cooled as thermal energy transfers from the first heat transfer fluid to the water, and the first heat transfer fluid flows to and cools a refrigeration component, e.g., the heat exchanging device 74, positioned in the cabin 34. The heat exchanging device 74 cools the air in the cabin 34 (note that the heat exchanging device 74 may be an evaporator when it is removing heat from the air in the cabin 34) and/or the first heat transfer fluid absorbs heat from the air in the cabin 34 via the heat exchanging device 74. As such, the air in the cabin 34 is cooled to a comfortable temperature for the occupants compared to the relatively warmer air outside of the marine vessel 10.

The compressor 71 causes the first heat transfer fluid to be conveyed through the first closed loop circuit 70 and the expansion valve 73A. The control system 100 controls one or more valves 76A-I to facilitate flow of the first heat transfer fluid through the first closed loop circuit 70 as noted above and through the coil 77.

The pump 87 pumps the potable water from the storage tank 82 through the valve 85 to the reservoir 81, and the heat is transferred from the first heat transfer fluid passing through the coil 77 to the potable water in the reservoir 81 thereby heating the potable water in the reservoir 81. Note that the coil 177 is depicted in gray lines as the second heat transfer fluid is not conveyed through the coil 177.

The pump 164 pumps relatively cooler water from the body of water 3 through the second open loop circuit 160 to the fourth heat exchanger 78D. The fourth heat exchanger 78D is configured to exchange heat between the water and the second heat transfer fluid in the second closed loop circuit 170 thereby warming the water in the second open loop circuit. The warmed water is dispensed from the second open loop circuit 160 back into the body of water 3, and the body of water 3 acts as a heat sink.

The second heat transfer fluid in the second closed loop circuit 170 is cooled as thermal energy transfers from the second heat transfer fluid to the water, and the second heat transfer fluid flows to and cools one or more components of the drive system 180. As such, the one or more components of the drive system 180 are cooled.

The pump 173 pumps the second heat transfer fluid through the second closed loop circuit 170. The control system 100 controls several valves 176A-C to facilitate flow of the second heat transfer fluid through the second closed loop circuit 170 as noted above.

Figure 7:
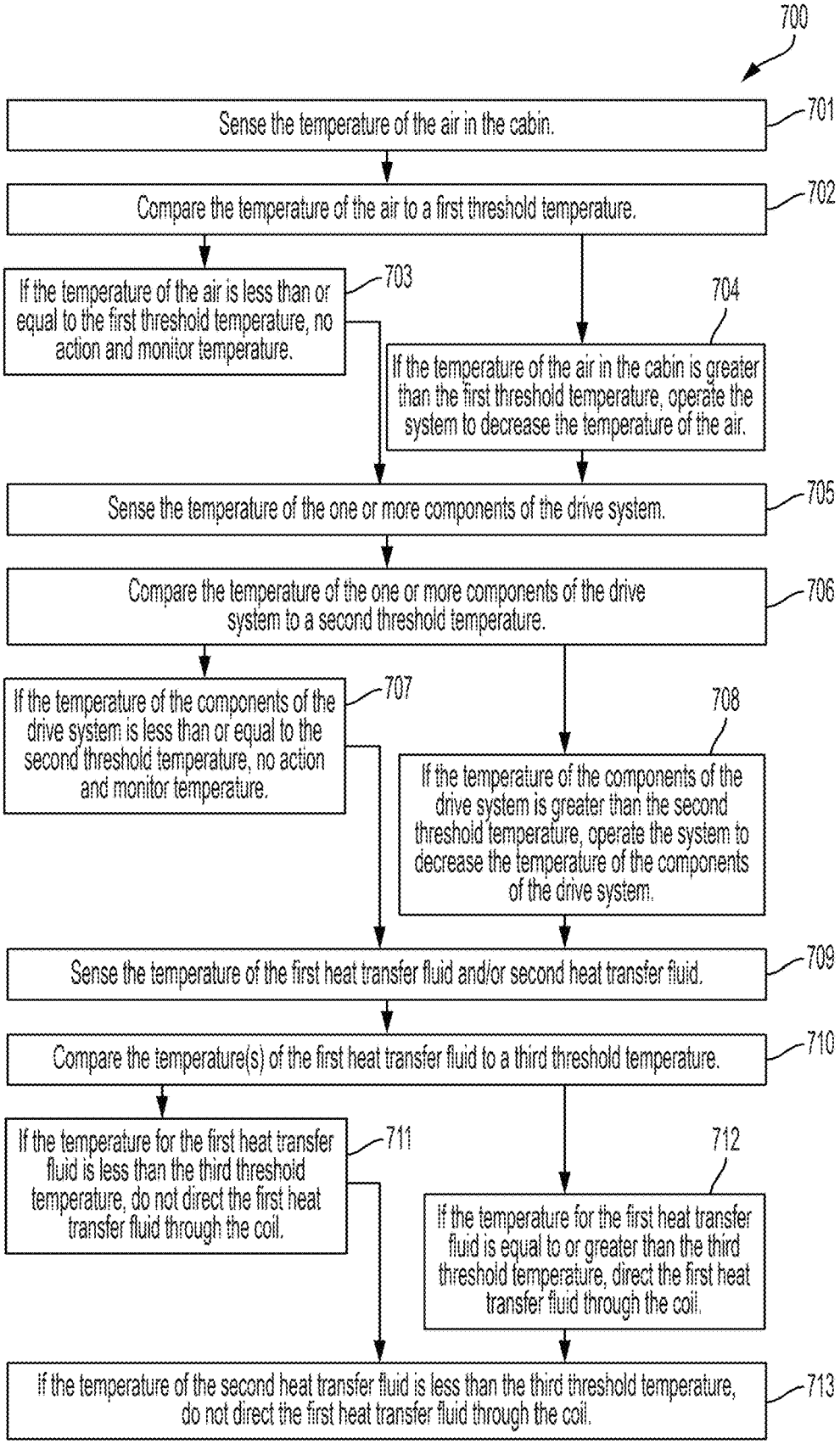

FIG. 7 depicts an example a method 700 for operating the thermal management system 40 in the second operational mode according to the present disclosure with reference to FIGS. 2 and 6. The method 700 begins at step 701 with a first temperature sensor 50 (FIG. 3) sensing the temperature of the air in the cabin 34. The control system 100 receives signals from the temperature sensor 50 corresponding to the sensed temperature of the air in the cabin 34 and other temperature sensors 50 noted herein in this example method 700. The control system 100 compares, at step 702, the sensed temperature of the air in the cabin 34 to the first threshold temperature.

If the control system 100 determines, at step 703, that the sensed temperature of the air in the cabin 34 is less than or equal to the first threshold temperature, the control system 100 does not send any immediate action control signals to other components of the system 40 and the control system 100 continuously monitors the sensed temperature of the air in the cabin 34.

However, if the control system 100 determines, at step 704, that the sensed temperature of the air in the cabin 34 is greater than the first threshold temperature, the control system 100 is configured to facilitate control of other components in the system 40 to thereby decrease the temperature of the air in the cabin 34. For example, the control system 100 operates the pump 64, the compressor 71, and/or the controls one more valves 76A-H such that heat is transferred from the air in the cabin 34 through heat exchanging device 74, the first closed loop circuit 70, and the first open loop circuit 60 to the body of water 3 (e.g., the body of water 3 acts as a heat sink for the excess heat removed from the air in the cabin 34)

At step 705, a second temperature sensor 50 senses the temperature of the one or more components of the drive system 180. The control system 100 compares, at step 706, the sensed temperature of the one or more components of the drive system 180 to the second threshold temperature.

If the control system 100 determines, at step 707, that the sensed temperature of the components of the drive system 180 is less than or equal to the second threshold temperature, the control system 100 does not send any immediate action control signals to other components of the system 40 and the control system 100 continuously monitors the sensed temperature of the components of the drive system 180.

However, if the control system 100 determines, at step 708 that the sensed temperature of the components of the drive system 180 is greater than the second threshold temperature, the control system 100 is configured to facilitate control of other components in the system 40 to thereby decrease the temperature of the components of the drive system 180. For example, the control system 100 operates the pump 173 and/or the valves 176A-C such that the second heat transfer fluid is conveyed through the second closed loop circuit 170 to cool the components of the drive system 180. The control system 100 also operates the pump 164 to pump relatively cooler water from the body of water 3 through the second open loop circuit 160 such that heat is transferred from the second heat transfer fluid in the second closed loop circuit 170 to the water in the second open loop circuit 160 via the fourth heat exchanger 78D. The heated water in the second open loop circuit 160 is returned to the body of water 3 (e.g., the body of water 3 acts as a heat sink for the excess heat removed from the components of the drive system 180).

At step 709, a third temperature sensor 50 senses the temperature of the first heat transfer fluid in the first closed loop circuit 70 and/or a fourth temperature sensor 50 senses the temperature of the second heat transfer fluid in the second closed loop circuit 170. The control system 100 compares, at step 710, the sensed temperature(s) of the first heat transfer fluid and/or the second heat transfer fluid, independently to the third threshold temperature.

At step 711, if the sensed temperature for the first heat transfer fluid is less than the third threshold temperature, the control system 100 determines that there is insufficient heat in the first heat transfer fluid to increase the temperature of the potable water in the water heater 80. Thus, the control system 100 controls one or more valves 76A-H such that the first heat transfer fluid does not flow through the coil 77.

At step 712, if the sensed temperature of the first heat transfer fluid is equal to or greater than the third threshold temperature, the control system 100 determines that there is sufficient heat in the first heat transfer fluid to increase the temperature of the potable water in the water heater 80. The control system 100 sends control signals to one or more valve 76A-H to such that the first heat transfer fluid flows through the coil 77. Heat is then transferred from the first heat transfer fluid to the potable water via the coil 77. The water heater 80 acts as a heat sink for the excess heat removed from the air in the cabin 34.

Note that in other examples the control system 100 is also configured to not operate the pump 64 so that no heat is transferred from the first heat transfer fluid to the water in the first open loop circuit 60. This optional control sequence advantageously prevents the first heat transfer fluid from being supercooled and damaging refrigeration components coupled to the first closed loop circuit 70 and/or transfers more heat from the first heat transfer fluid to the potable water in the water heater 80.

At step 713, if the sensed temperature for the second heat transfer fluid is less than the third threshold temperature, the control system 100 determines that there is insufficient heat in the second heat transfer fluid to increase the temperature of the potable water in the water heater 80. Thus, the control system 100 controls one or more valves 176A-C such that the second heat transfer fluid does not flow through the coil 177.

Figure 8:
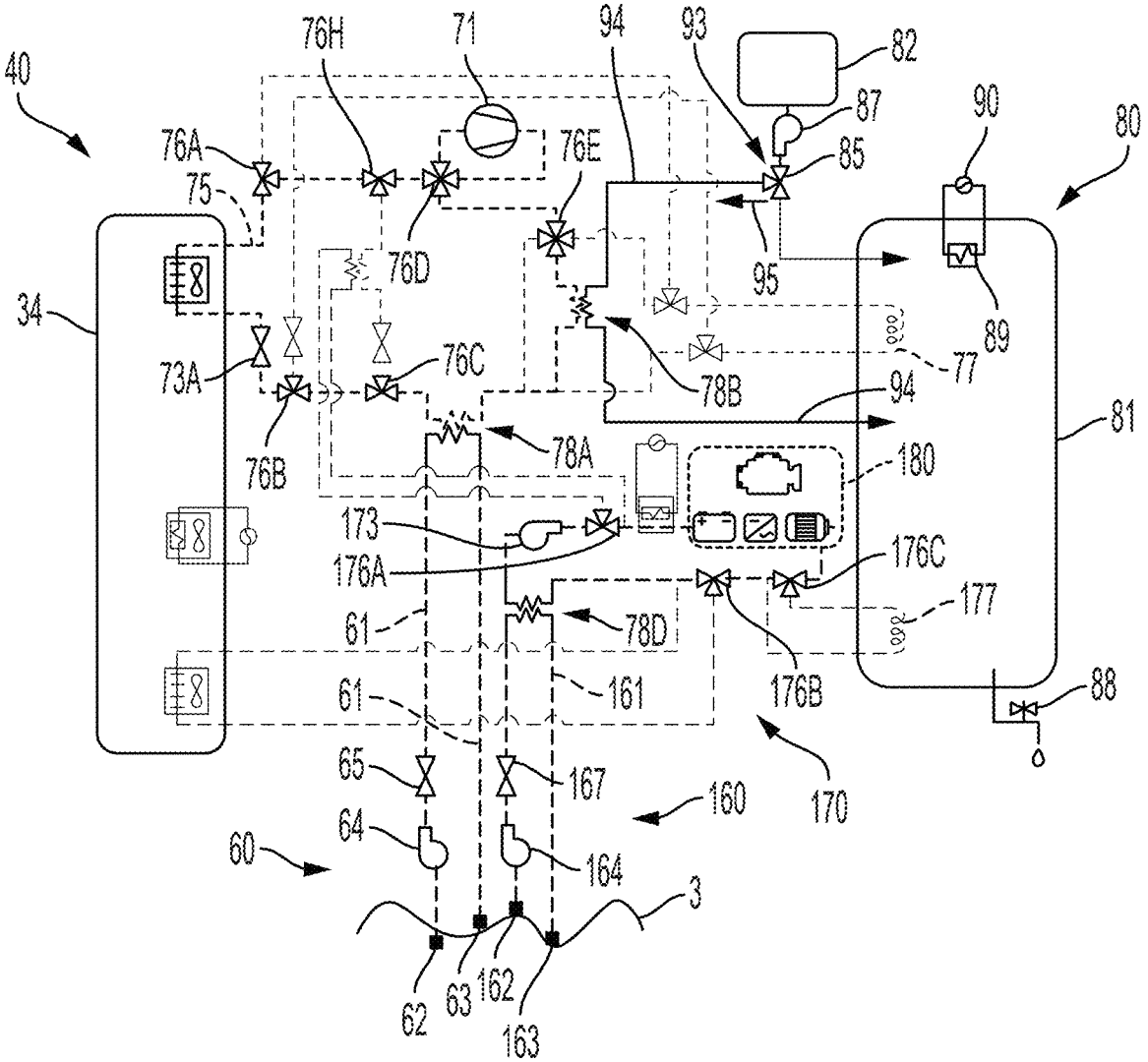

FIG. 8 depicts the thermal management system 40 in a third operational mode. The third operational mode is advantageously utilized during warm weather or summer days. In this third operational mode, the pump 64 pumps relatively cooler water from the body of water 3 through the first open loop circuit 60 to the first heat exchanger 78A. The first heat exchanger 78A is configured to exchange heat between the water and the first heat transfer fluid in the first closed loop circuit 70 thereby warming the water in the first open loop circuit. The warmed water is dispensed from the first open loop circuit 60 back into the body of water 3, and the body of water 3 acts as a heat sink.

The first heat transfer fluid in the first closed loop circuit 70 is cooled as thermal energy transfers from the first heat transfer fluid to the water, and the first heat transfer fluid flows to and cools a refrigeration component, e.g., the heat exchanging device 74, positioned in the cabin 34 (note that the heat exchanging device 74 may be an evaporator when it is removing heat from the cabin 34). The heat exchanging device 74 cools the air in the cabin 34 and/or the first heat transfer fluid absorbs heat from the air in the cabin 34 via the heat exchanging device 74. As such, the air in the cabin 34 is cooled to a comfortable temperature for the occupants compared to the relatively warmer air outside of the marine vessel 10.

The compressor 71 causes the first heat transfer fluid to be conveyed through the first closed loop circuit 70 and the expansion valve 73A. The control system 100 controls one or more valves 76A-I to facilitate flow of the first heat transfer fluid through the first closed loop circuit 70 as noted above and through the second heat exchanger 78B.

The pump 87 pumps the potable water from the storage tank 82 through the valve 85 to the second heat exchanger 78B and the reservoir 81. The heat in the first heat transfer fluid is transferred to the potable water via the second heat exchanger 78B. Note that the coils 77, 177 are depicted in gray lines as the first heat transfer fluid and second heat transfer fluid, respectively, is not conveyed through the coils 77, 177.

The pump 164 pumps relatively cooler water from the body of water 3 through the second open loop circuit 160 to the fourth heat exchanger 78D. The fourth heat exchanger 78D is configured to exchange heat between the water and the second heat transfer fluid in the second closed loop circuit 170 thereby warming the water in the second open loop circuit. The warmed water is dispensed from the second open loop circuit 160 back into the body of water 3, and the body of water 3 acts as a heat sink.

The second heat transfer fluid in the second closed loop circuit 170 is cooled as thermal energy transfers from the second heat transfer fluid to the water, and the second heat transfer fluid flows to and cools one or more components of the drive system 180. As such, the one or more components of the drive system 180 are cooled (e.g., the components of the drive system 180 are cooled to or below the second threshold temperature).

The pump 173 pumps the second heat transfer fluid through the second closed loop circuit 170. The control system 100 controls several valves 176A-C to facilitate flow of the second heat transfer fluid through the second closed loop circuit 170 as noted above.

Figure 9:
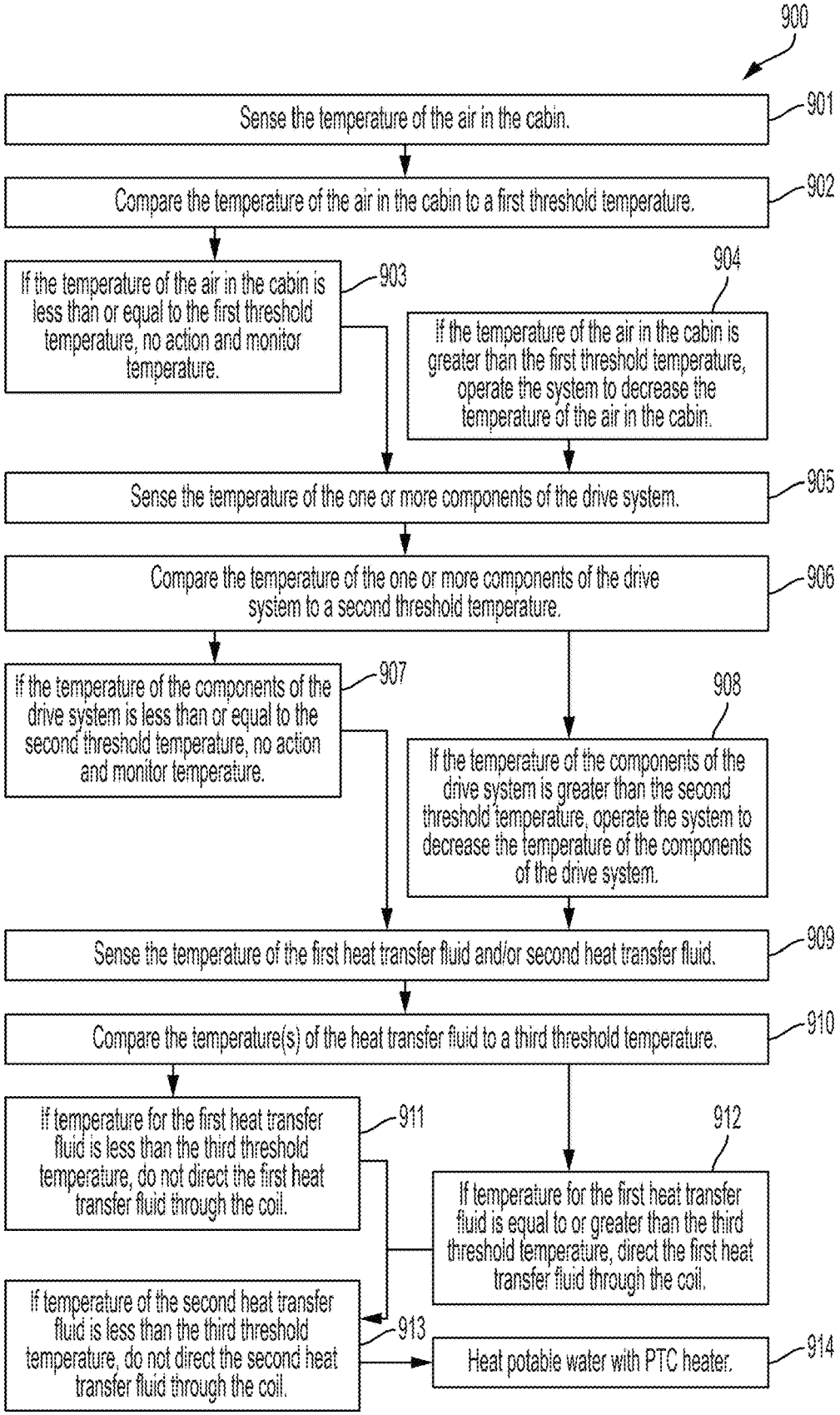

FIG. 9 depicts an example method 900 for operating the thermal management system 40 in the third operational mode according to the present disclosure with reference to FIGS. 2 and 8. The method 900 begins at step 901 with a first temperature sensor 50 (FIG. 3) sensing the temperature of the air in the cabin 34. The control system 100 receives signals from the temperature sensor 50 corresponding to the sensed temperature of the air in the cabin 34 and other temperature sensors 50 noted herein in this example method 900. The control system 100 compares, at step 902, the sensed temperature of the air in the cabin 34 to the first threshold temperature.

If the control system 100 determines, at step 903, that the sensed temperature of the air in the cabin 34 is less than or equal to the first threshold temperature, the control system 100 does not send any immediate action control signals to other components of the system 40 and the control system 100 continuously monitors the sensed temperature of the air in the cabin 34.

However, if the control system 100 determines, at step 904, that the sensed temperature of the air in the cabin 34 is greater than the first threshold temperature, the control system 100 is configured to facilitate control of other components in the system 40 to thereby decrease the temperature of the air in the cabin 34. For example, the control system 100 operates the pump 64, the compressor 71, and/or the controls one more valves 76A-H such that heat is transferred from the air in the cabin 34 through heat exchanging device 74, the first closed loop circuit 70, and the first open loop circuit 60 to the body of water 3 (e.g., the body of water 3 acts as a heat sink for the excess heat removed from the air in the cabin 34)

At step 905, a second temperature sensor 50 senses the temperature of the one or more components of the drive system 180. The control system 100 compares, at step 906, the sensed temperature of the one or more components of the drive system 180 to the second threshold temperature.

If the control system 100 determines, at step 907, that the sensed temperature of the components of the drive system 180 is less than or equal to the second threshold temperature, the control system 100 does not send any immediate action control signals to other components of the system 40 and the control system 100 continuously monitors the sensed temperature of the components of the drive system 180.

However, if the control system 100 determines, at step 908 that the sensed temperature of the components of the drive system 180 is greater than the second threshold temperature, the control system 100 is configured to facilitate control of other components in the system 40 to thereby decrease the temperature of the components of the drive system 180. For example, the control system 100 operates the pump 173 and/or the valves 176A-C such that the second heat transfer fluid is conveyed through the second closed loop circuit 170 to cool the components of the drive system 180. The control system 100 also operates the pump 164 to pump relatively cooler water from the body of water 3 through the second open loop circuit 160 such that heat is transferred from the second heat transfer fluid in the second closed loop circuit 170 to the water in the second open loop circuit 160 via the fourth heat exchanger 78D. The heated water in the second open loop circuit 160 is returned to the body of water 3 (e.g., the body of water 3 acts as a heat sink for the excess heat removed from the components of the drive system 180).

At step 909, a third temperature sensor 50 senses the temperature of the first heat transfer fluid in the first closed loop circuit 70 and/or a fourth temperature sensor 50 senses the temperature of the second heat transfer fluid in the second closed loop circuit 170. The control system 100 compares, at step 910, the sensed temperature(s) of the first heat transfer fluid and/or the second heat transfer fluid, independently to the third threshold temperature.

At step 911, if the sensed temperature of the first heat transfer fluid is less than the third threshold temperature, the control system 100 determines that there is insufficient heat in the first heat transfer fluid to increase the temperature of the potable water in the water heater 80. Thus, the control system 100 controls one or more valves 76A-H such that the first heat transfer fluid does not flow through the coil 77 or the second heat exchanger 78B.

At step 912, if the sensed temperature of the first heat transfer fluid is equal to or greater than the third threshold temperature, the control system 100 determines that there is sufficient heat in the first heat transfer fluid to increase the temperature of the potable water in the water heater 80. The control system 100 sends control signals to one or more valve 76A-H to such that the first heat transfer fluid flows through second heat exchanger 78B. Heat is then transferred from the first heat transfer fluid to the potable water via the second heat exchanger 78B. The potable water in the reservoir 81 acts as a heat sink for the excess heat removed from the air in the cabin 34.

At step 913, if the sensed temperature for the second heat transfer fluid is less than the third threshold temperature, the control system 100 determines that there is insufficient heat in the second heat transfer fluid to increase the temperature of the potable water in the water heater 80. Thus, the control system 100 controls one or more valves 176A-C such that the second heat transfer fluid does not flow through the coil 177.

The control system 100, at step 914, sends control signals to the PTC heater 89 to generate heat that thereby heats the potable water in the water heater 80. The control system 100 continues to operate the PTC heater 89 until the sensed temperature of the potable water increases to or above the third threshold temperature.

Figure 10:
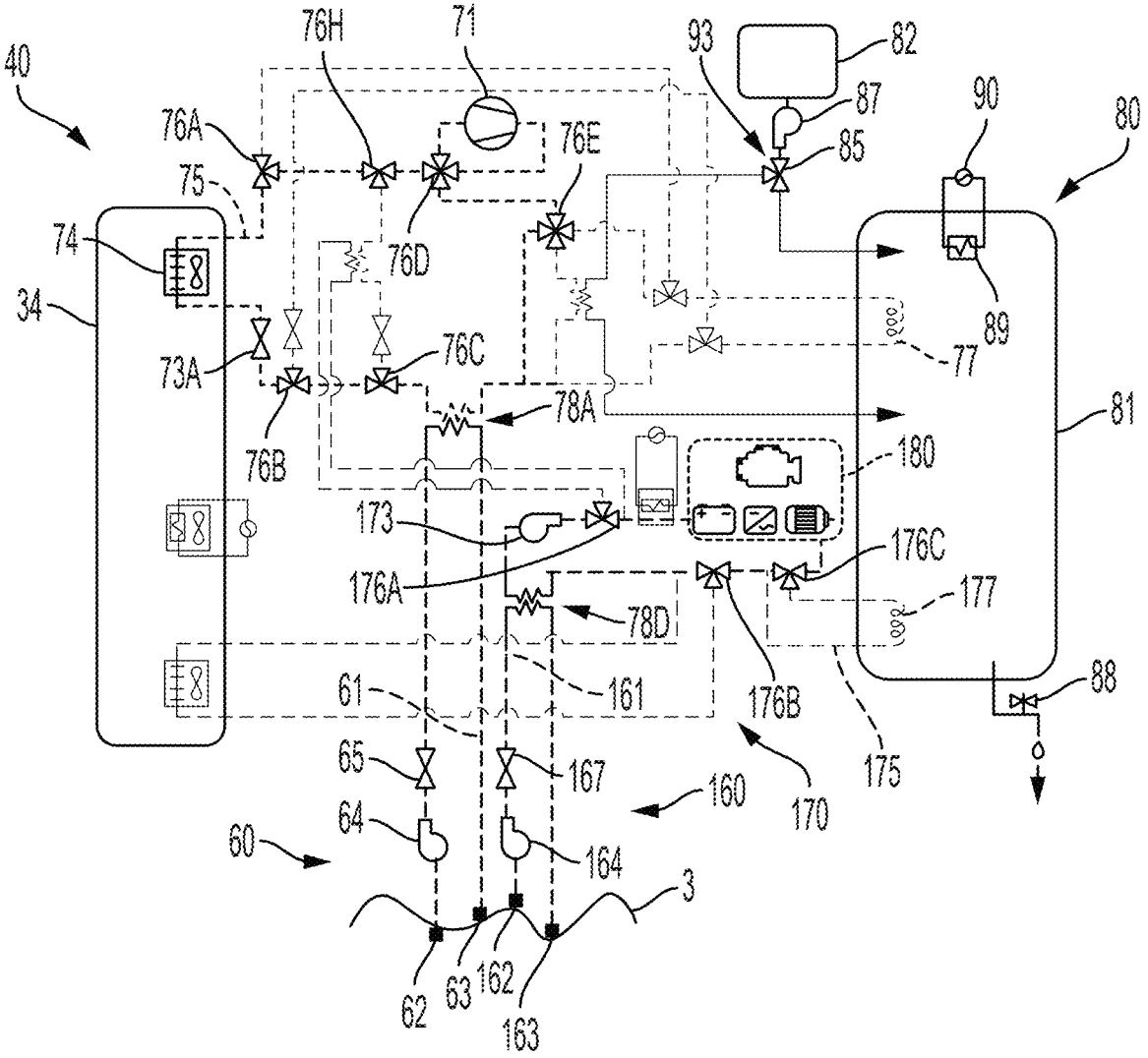

FIG. 10 depicts the thermal management system 40 in a fourth operational mode. The fourth operational mode is advantageously utilized during warm weather or summer days. In this fourth operational mode, the pump 64 pumps relatively cooler water from the body of water 3 through the first open loop circuit 60 to the first heat exchanger 78A. The first heat exchanger 78A is configured to exchange heat between the water and the first heat transfer fluid in the first closed loop circuit 70 thereby warming the water in the first open loop circuit 60. The warmed water is dispensed from the first open loop circuit 60 back into the body of water 3, and the body of water 3 acts as a heat sink.

The first heat transfer fluid in the first closed loop circuit 70 is cooled as thermal energy transfers from the first heat transfer fluid to the water, and the first heat transfer fluid flows to and cools a refrigeration component, e.g., the heat exchanging device 74, positioned in the cabin 34. The heat exchanging device 74 cools the air in the cabin 34 and/or the first heat transfer fluid absorbs heat from the air in the cabin 34 via the heat exchanging device 74. As such, the air in the cabin 34 is cooled to a comfortable temperature for the occupants compared to the relatively warmer air outside of the marine vessel 10.

The compressor 71 causes the first heat transfer fluid to be conveyed through the first closed loop circuit 70 and the expansion valve 73A. The control system 100 controls one or more valves 76A-I to facilitate flow of the first heat transfer fluid through the first closed loop circuit 70 as noted above.

The pump 164 pumps relatively cooler water from the body of water 3 through the second open loop circuit 160 to the fourth heat exchanger 78D. The fourth heat exchanger 78D is configured to exchange heat between the water and the second heat transfer fluid in the second closed loop circuit 170 thereby warming the water in the second open loop circuit. The warmed water is dispensed from the second open loop circuit 160 back into the body of water 3, and the body of water 3 acts as a heat sink.

The second heat transfer fluid in the second closed loop circuit 170 is cooled as thermal energy transfers from the second heat transfer fluid to the water, and the second heat transfer fluid flows to and cools one or more components of the drive system 180. As such, the one or more components of the drive system 180 are cooled.

The pump 173 pumps the second heat transfer fluid through the second closed loop circuit 170. The control system 100 controls several valves 176A-C to facilitate flow of the second heat transfer fluid through the second closed loop circuit 170 as noted above and the coil 177.

The pump 87 pumps the potable water from the storage tank 82 through the valve 85 to the reservoir 81, and the heat is transferred from the second heat transfer fluid passing through the coil 177 to the potable water in the reservoir 81 thereby heating the potable water in the reservoir 81. Note that the coil 77 is depicted in gray lines as the first heat transfer fluid is not conveyed through the coil 77.

Figure 11:
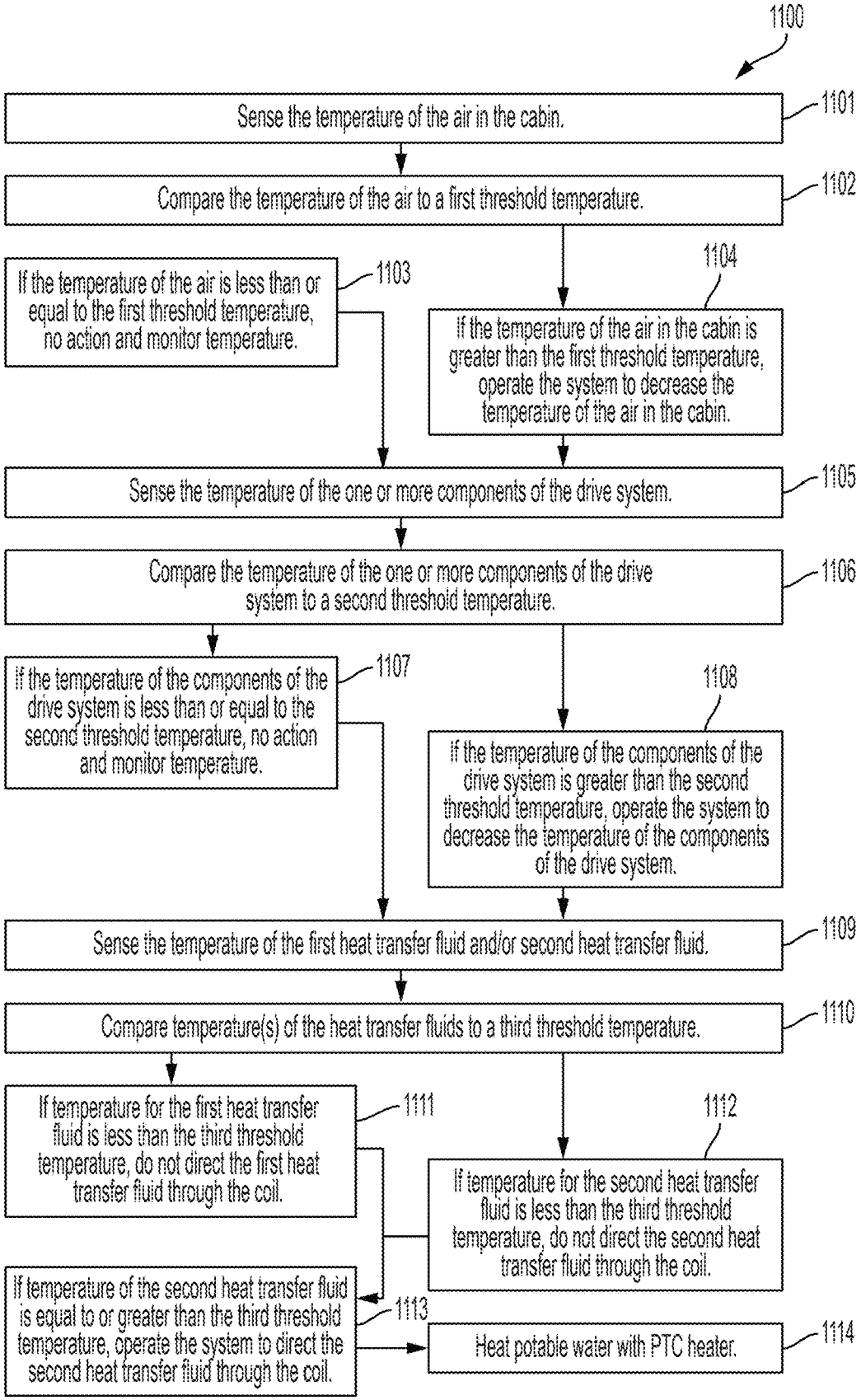

FIG. 11 depicts an example method 1100 for operating the thermal management system 40 in the fourth operational mode according to the present disclosure with reference to FIGS. 2 and 10. The method 1100 begins at step 1101 with a first temperature sensor 50 (FIG. 3) sensing the temperature of the air in the cabin 34. The control system 100 receives signals from the temperature sensor 50 corresponding to the sensed temperature of the air in the cabin 34 and other temperature sensors 50 noted herein in this example method 700. The control system 100 compares, at step 1102, the sensed temperature of the air in the cabin 34 to the first threshold temperature.

If the control system 100 determines, at step 1103, that the sensed temperature of the air in the cabin 34 is less than or equal to the first threshold temperature, the control system 100 does not send any immediate action control signals to other components of the system 40 and the control system 100 continuously monitors the sensed temperature of the air in the cabin 34.

However, if the control system 100 determines, at step 1104, that the sensed temperature of the air in the cabin 34 is greater than the first threshold temperature, the control system 100 is configured to facilitate control of other components in the system 40 to thereby decrease the temperature of the air in the cabin 34. For example, the control system 100 operates the pump 64, the compressor 71, and/or the controls one more valves 76A-H such that heat is transferred from the air in the cabin 34 through heat exchanging device 74, the first closed loop circuit 70, and the first open loop circuit 60 to the body of water 3 (e.g., the body of water 3 acts as a heat sink for the excess heat removed from the air in the cabin 34)

At step 1105, a second temperature sensor 50 senses the temperature of the one or more components of the drive system 180. The control system 100 compares, at step 1106, the sensed temperature of the one or more components of the drive system 180 to the second threshold temperature.

If the control system 100 determines, at step 1107, that the sensed temperature of the components of the drive system 180 is less than or equal to the second threshold temperature, the control system 100 does not send any immediate action control signals to other components of the system 40 and the control system 100 continuously monitors the sensed temperature of the components of the drive system 180.

However, if the control system 100 determines, at step 1108 that the sensed temperature of the components of the drive system 180 is greater than the second threshold temperature, the control system 100 is configured to facilitate control of other components in the system 40 to thereby decrease the temperature of the components of the drive system 180. For example, the control system 100 operates the pump 173 and/or the valves 176A-C such that the second heat transfer fluid is conveyed through the second closed loop circuit 170 to cool the components of the drive system 180. The control system 100 also operates the pump 164 to pump relatively cooler water from the body of water 3 through the second open loop circuit 160 such that heat is transferred from the second heat transfer fluid in the second closed loop circuit 170 to the water in the second open loop circuit 160 via the fourth heat exchanger 78D. The heated water in the second open loop circuit 160 is returned to the body of water 3 (e.g., the body of water 3 acts as a heat sink for the excess heat removed from the components of the drive system 180).

At step 1109, a third temperature sensor 50 senses the temperature of the first heat transfer fluid in the first closed loop circuit 70 and/or a fourth temperature sensor 50 senses the temperature of the second heat transfer fluid in the second closed loop circuit 170. The control system 100 compares, at step 1110, the sensed temperature(s) of the first heat transfer fluid and/or the second heat transfer fluid, independently to the third threshold temperature.

At step 1111, if the sensed temperature for the first heat transfer fluid is less than the third threshold temperature, the control system 100 determines that there is insufficient heat in the first heat transfer fluid to increase the temperature of the potable water in the water heater 80. Thus, the control system 100 controls one or more valves 76A-H such that the first heat transfer fluid does not flow through the coil 77.

At step 1112, if the sensed temperature for the second heat transfer fluid is less than the third threshold temperature, the control system 100 determines that there is insufficient heat in the second heat transfer fluid to increase the temperature of the potable water in the water heater 80. Thus, the control system 100 controls one or more valves 176A-C such that the second heat transfer fluid does not flow through the coil 177.

At step 1113, if the sensed temperature of the second heat transfer fluid is equal to or greater than the third threshold temperature, the control system 100 determines that there is sufficient heat in the second heat transfer fluid to increase the temperature of the potable water in the water heater 80. The control system 100 sends control signals to one or more valves 176A-C to such that the second heat transfer fluid flows through the coil 177. Heat is then transferred from the second heat transfer fluid to the potable water via the coil 177. The water heater 80 acts as a heat sink for the excess heat removed from the components of the drive system 180.

The control system 100, at step 1114, sends control signals to the PTC heater 89 to generate supplemental heat that thereby further heats the potable water in the water heater 80. The control system 100 continues to operate the PTC heater 89 until the sensed temperature of the potable water increases to or above the third threshold temperature.

Figure 12:
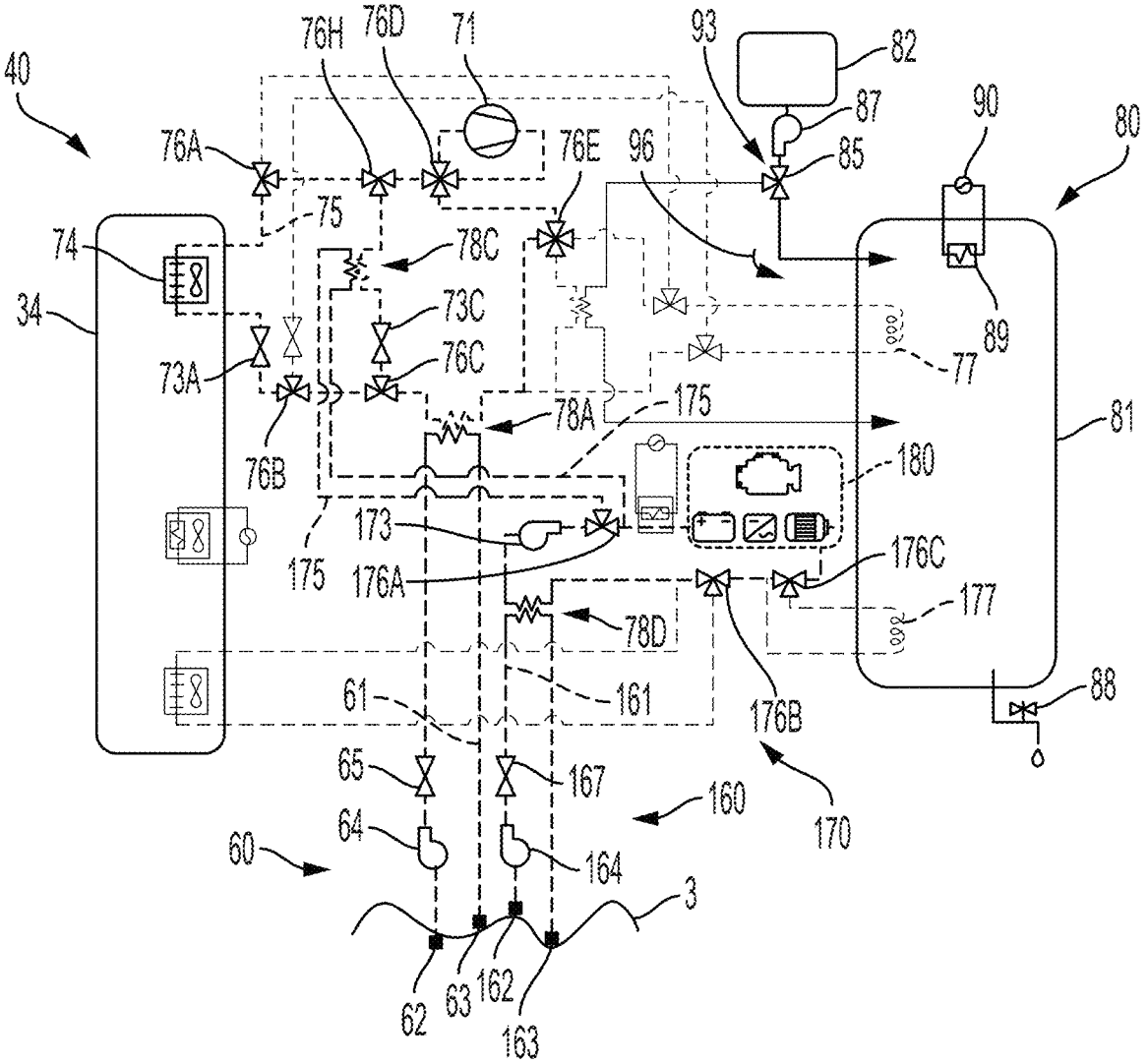

FIG. 12 depicts the thermal management system 40 in a fifth operational mode. The fifth operational mode is advantageously utilized during warm weather or summer days. In this fifth operational mode, the pump 64 pumps relatively cooler water from the body of water 3 through the first open loop circuit 60 to the first heat exchanger 78A. The first heat exchanger 78A is configured to exchange heat between the water and the first heat transfer fluid in the first closed loop circuit 70 thereby warming the water in the first open loop circuit 60. The warmed water is dispensed from the first open loop circuit 60 back into the body of water 3, and the body of water 3 acts as a heat sink.

The first heat transfer fluid in the first closed loop circuit 70 is cooled as thermal energy transfers from the first heat transfer fluid to the water, and the first heat transfer fluid flows to and cools a refrigeration component, e.g., the heat exchanging device 74, positioned in the cabin 34. The heat exchanging device 74 cools the air in the cabin 34 and/or the first heat transfer fluid absorbs heat from the air in the cabin 34 via the heat exchanging device 74. As such, the air in the cabin 34 is cooled to a comfortable temperature for the occupants compared to the relatively warmer air outside of the marine vessel 10.

In addition, the first heat transfer fluid in the first closed loop circuit 70 passes through the third heat exchanger 78C such that the heat is exchanged between the first heat transfer fluid in the first closed loop circuit 70 and the second heat transfer fluid in the second closed loop circuit 140. In certain examples, the second heat transfer fluid is cooled and thus the component(s) of the drive system 180 are also cooled (e.g., the components of the drive system 180 are cooled to or below the second threshold temperature).

The compressor 71 causes the first heat transfer fluid to be conveyed through the first closed loop circuit 70 and the expansion valves 73A, 73C. The control system 100 controls one or more valves 76A-I to facilitate flow of the first heat transfer fluid through the first closed loop circuit 70 as noted above.

Optionally, the pump 164 pumps relatively cooler water from the body of water 3 through the second open loop circuit 160 to the fourth heat exchanger 78D. The fourth heat exchanger 78D is configured to exchange heat between the water and the second heat transfer fluid in the second closed loop circuit 170 thereby warming the water in the second open loop circuit. The warmed water is dispensed from the second open loop circuit 160 back into the body of water 3, and the body of water 3 acts as a heat sink. This optional function supplements the cooling of second heat transfer fluid in the second closed loop circuit 170 and further cools the components of the drive system 180. These functions may be advantageous in the event that more cooling than what can be provided via transfer of heat between the first heat transfer fluid and the second heat transfer fluid at the third heat exchanger 78C (as noted above) is necessary.

The pump 173 pumps the second heat transfer fluid through the second closed loop circuit 170. The control system 100 controls several valves 176A-C to facilitate flow of the second heat transfer fluid through the second closed loop circuit 170 as noted above.

The pump 87 pumps the potable water from the storage tank 82 through the valve 85 to the reservoir 81, and the PTC heater 89 heats the potable water in the reservoir 81. Note that the coils 77, 177 are depicted in gray lines as the first heat transfer fluid and the second heat transfer fluid, respectively, are not conveyed through the coils 77, 177.

Figure 13:
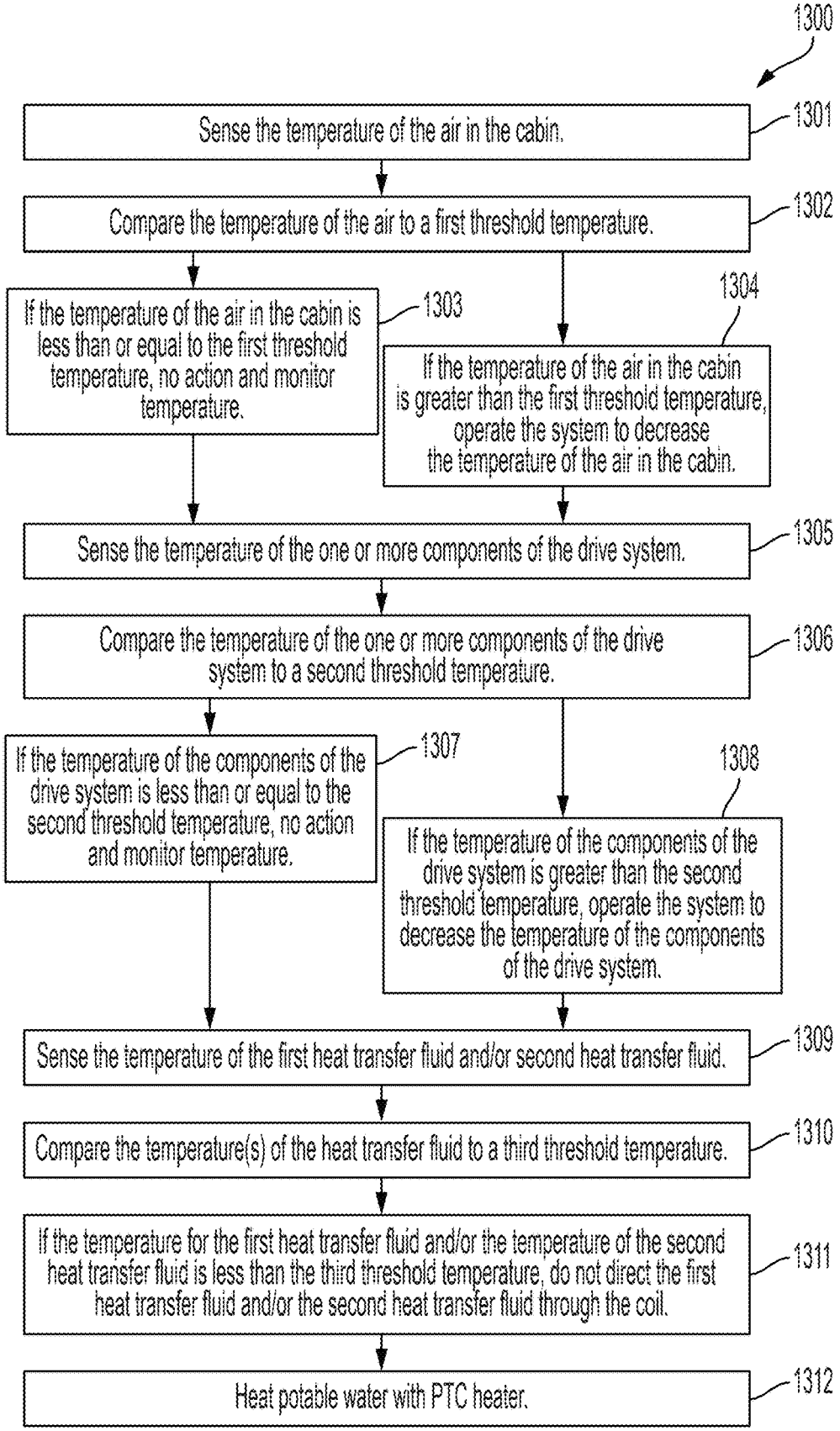

FIG. 13 depicts an example method 1300 for operating the thermal management system 40 in the fifth operational mode according to the present disclosure with reference to FIGS. 2 and 12. The method 1300 begins at step 1301 with a first temperature sensor 50 (FIG. 3) sensing the temperature of the air in the cabin 34. The control system 100 receives signals from the temperature sensor 50 corresponding to the sensed temperature of the air in the cabin 34 and other temperature sensors 50 noted herein in this example method 700. The control system 100 compares, at step 1302, the sensed temperature of the air in the cabin 34 to the first threshold temperature.

If the control system 100 determines, at step 1303, that the sensed temperature of the air in the cabin 34 is less than or equal to the first threshold temperature, the control system 100 does not send any immediate action control signals to other components of the system 40 and the control system 100 continuously monitors the sensed temperature of the air in the cabin 34.

However, if the control system 100 determines, at step 1304, that the sensed temperature of the air in the cabin 34 is greater than the first threshold temperature, the control system 100 is configured to facilitate control of other components in the system 40 to thereby decrease the temperature of the air in the cabin 34. For example, the control system 100 operates the pump 64, the compressor 71, and/or the controls one more valves 76A-H such that heat is transferred from the air in the cabin 34 through the heat exchanging device 74, the first closed loop circuit 70, and the first open loop circuit 60 to the body of water 3 (e.g., the body of water 3 acts as a heat sink for the excess heat removed from the air in the cabin 34)

At step 1305, a second temperature sensor 50 senses the temperature of the one or more components of the drive system 180. The control system 100 compares, at step 1306, the sensed temperature of the one or more components of the drive system 180 to the second threshold temperature.

If the control system 100 determines, at step 1307, that the sensed temperature of the components of the drive system 180 is less than or equal to the second threshold temperature, the control system 100 does not send any immediate action control signals to other components of the system 40 and the control system 100 continuously monitors the sensed temperature of the components of the drive system 180.

However, if the control system 100 determines, at step 1308 that the sensed temperature of the components of the drive system 180 is greater than the second threshold temperature, the control system 100 is configured to facilitate control of other components in the system 40 to thereby decrease the temperature of the components of the drive system 180. For example, the control system 100 operates the pump 173 and/or valves 176A-C such that the second heat transfer fluid is conveyed through the second closed loop circuit 170 and the third heat exchanger 78C to cool the components of the drive system 180.

Optionally, the control system 100 may also operate the pump 164 to pump relatively cooler water from the body of water 3 through the second open loop circuit 160 such that heat is transferred from the second heat transfer fluid in the second closed loop circuit 170 to the water in the second open loop circuit 160 via the fourth heat exchanger 78D. The heated water in the second open loop circuit 160 is returned to the body of water 3 (e.g., the body of water 3 acts as a heat sink for the excess heat removed from the components of the drive system 180).

At step 1309, a third temperature sensor 50 senses the temperature of the first heat transfer fluid in the first closed loop circuit 70 and/or a fourth temperature sensor 50 senses the temperature of the second heat transfer fluid in the second closed loop circuit 170. The control system 100 compares, at step 1310, the sensed temperature(s) of the first heat transfer fluid and/or the second heat transfer fluid, independently to the third threshold temperature.

At step 1311, if the sensed temperature for the first heat transfer fluid is less than the third threshold temperature, the control system 100 determines that there is insufficient heat in the first heat transfer fluid to increase the temperature of the potable water in the water heater 80. Thus, the control system 100 controls one or more valves 76A-H such that the first heat transfer fluid does not flow through the coil 77. Similarly, if the sensed temperature for the second heat transfer fluid is less than the third threshold temperature, the control system 100 determines that there is insufficient heat in the second heat transfer fluid to increase the temperature of the potable water in the water heater 80. Thus, the control system 100 controls one or more valves 176A-C such that the second heat transfer fluid does not flow through the coil 177.

The control system 100, at step 1312, sends control signals to the PTC heater 89 to generate heat that thereby heats the potable water in the water heater 80. The control system 100 continues to operate the PTC heater 89 until the sensed temperature of the potable water increases to or above the third threshold temperature.

Figure 14:
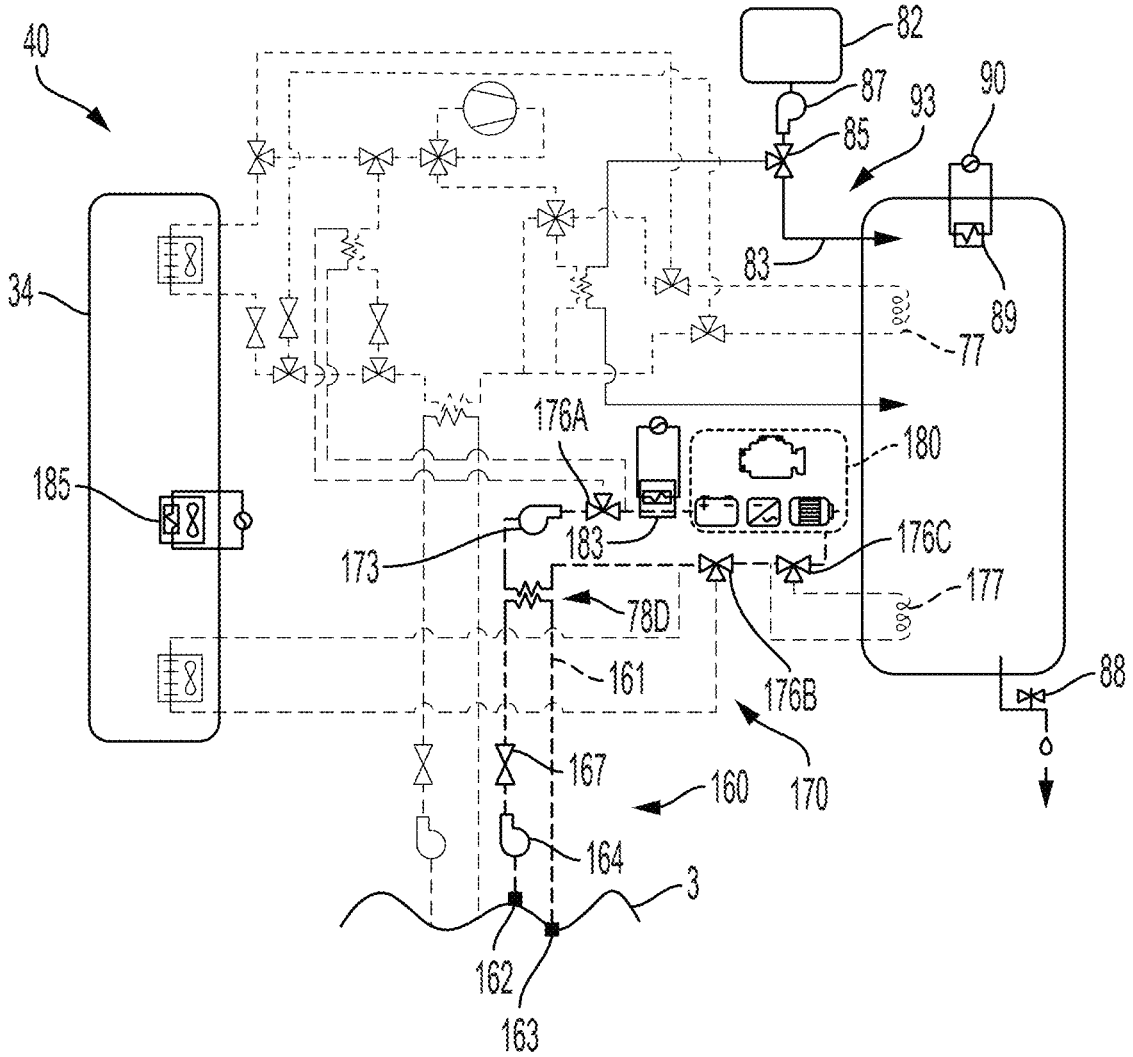

FIG. 14 depicts the thermal management system 40 in a sixth operational mode. The sixth operational mode is advantageously utilized during cold weather or winter days.

The pump 87 pumps the potable water from the storage tank 82 through the valve 85 to the reservoir 81, and the PTC heater 89 heats the potable water in the reservoir 81. Note that the coils 77, 177 are depicted in gray lines as the first heat transfer fluid and the second heat transfer fluid, respectively, are not conveyed through the coils 77, 177.

The pump 164 pumps relatively warmer water from the body of water 3 through the second open loop circuit 160 to the fourth heat exchanger 78D. The fourth heat exchanger 78D is configured to exchange heat between the water and the second heat transfer fluid in the second closed loop circuit 170 thereby cooling the water in the second open loop circuit. The cooled water is dispensed from the second open loop circuit 160 back into the body of water 3, and the body of water 3 acts as a heat source. In this example, the pump 164 and/or second open loop circuit 160 are operating in a heat pump mode.

The second heat transfer fluid in the second closed loop circuit 170 is warmed as thermal energy transfers from the water to the second heat transfer fluid, and the second heat transfer fluid flows to and warms one or more components of the drive system 180. As such, the one or more components of the drive system 180 are warmed to a fourth threshold temperature (described herein). Optionally, the PTC heater 183 is operated to warm the second heat transfer fluid and thereby warm one or more components of the drive system 180.

The pump 173 pumps the second heat transfer fluid through the second closed loop circuit 170. The control system 100 controls several valves 176A-C to facilitate flow of the second heat transfer fluid through the second closed loop circuit 170 as noted above. Optionally, the PTC heater 183 heats the second heat transfer fluid in the second closed loop circuit 170 for warming one or more components of the drive system 180 and supplementing the heat transferred from the water to the second heat transfer fluid. Note that once the drive system 180 is operating and producing heat, the thermal management system 40 may change operation of the second open loop circuit 160 and components coupled thereto to cool the components of the drive system 180 (as described with reference to other Figures in the present disclosure).

The PTC heater 185 is configured to heat the air in the cabin 34.

Figure 15:
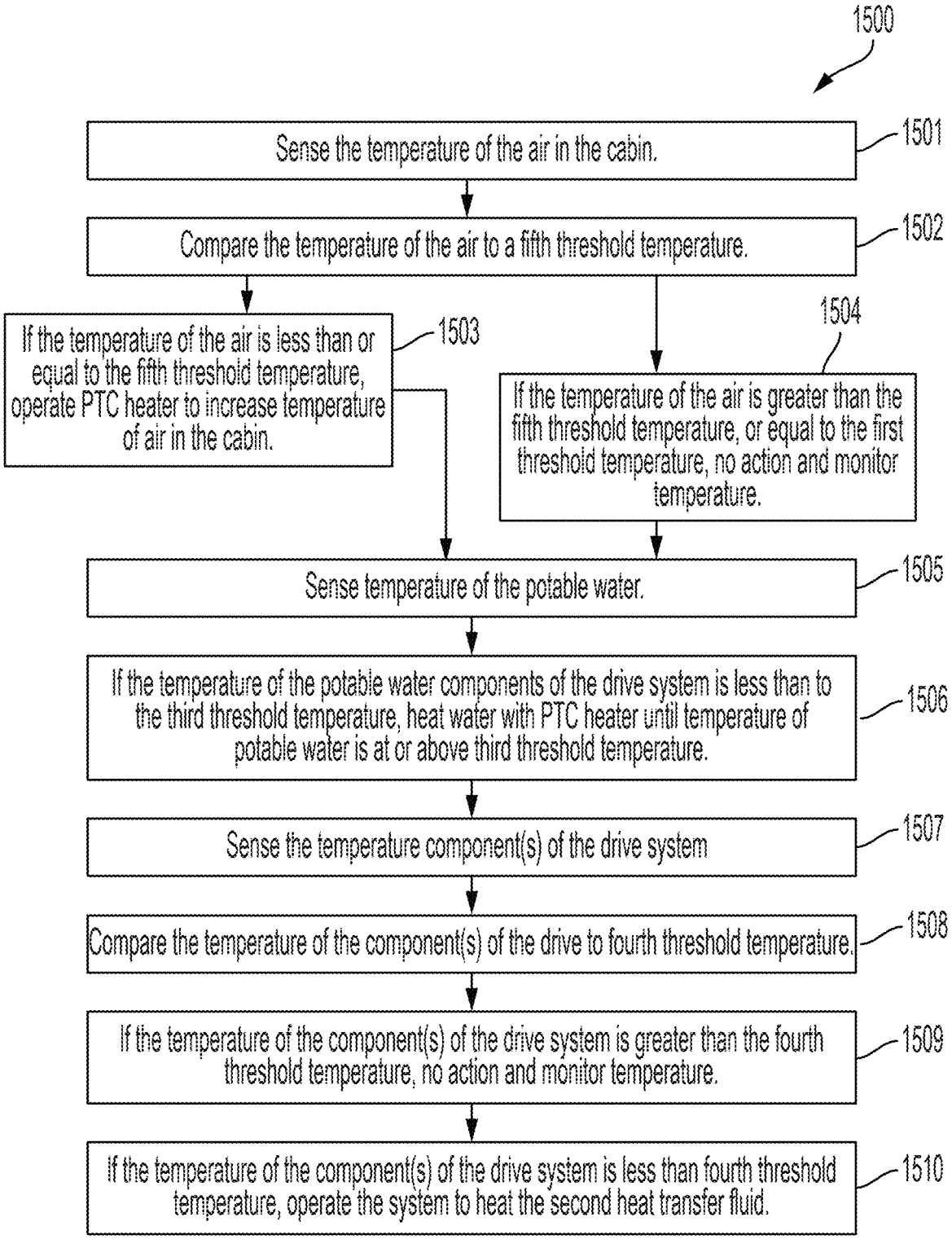

FIG. 15 depicts an example method 1500 for operating the thermal management system 40 in the sixth operational mode according to the present disclosure with reference to FIGS. 2 and 14. The method 1500 begins at step 1501 with a first temperature sensor 50 (FIG. 3) sensing the temperature of the air in the cabin 34. The control system 100 receives signals from the temperature sensor 50 corresponding to the sensed temperature of the air in the cabin 34 and other temperature sensors 50 noted herein in this example method 1500. The control system 100 compares, at step 1502, the sensed temperature of the air in the cabin 34 to a fifth threshold temperature (e.g., the fifth threshold temperature is based on an algorithm, acceptable temperature range, temperature value in a look-up table). For example, the fifth threshold temperature is a minimum temperature predetermined by the occupants of the marine vessel for air in the cabin 34 (e.g., 14.0 degrees Celsius).

If the control system 100 determines, at step 1503, that the sensed temperature of the air in the cabin 34 is less than the fifth threshold temperature, control system 100 controls the PTC heater 89 to generate heat that thereby heats the air in the cabin 34. The control system 100 continues to operate the PTC heater 89 until the sensed temperature of the potable water increases to or above the fifth threshold temperature.

However, if the control system 100 determines, at step 1504 that the sensed temperature of the air in the cabin 34 is at or greater than the fifth threshold temperature, the control system 100 does not send any immediate action control signals to other components of the system 40 and the control system 100 continuously monitors the sensed temperature of the air in the cabin 34.

At step 1505, a temperature sensor 50 senses the temperature of the potable water in the water heater 80. If the sensed temperature of the potable water is less than the third threshold temperature the control system 100, at step 1506, sends control signals to the PTC heater 89 to generate heat that thereby heats the potable water in the water heater 80. The control system 100 continues to operate the PTC heater 89 until the sensed temperature of the potable water increases to or above the third threshold temperature.

At step 1507, a temperature sensor 50 senses the temperature of the one or more components of the drive system 180. The control system 100 compares, at step 1508, the sensed temperature of the one or more components of the drive system 180 to the fourth threshold temperature. temperature (e.g., the fourth threshold temperature may correspond to the minimum temperature of the power source, such as a battery, which for example may be 20.0 degrees Celsius) Note that in certain examples the fourth threshold temperature is based on an algorithm, acceptable temperature range, temperature value in a look-up table. In one non-limiting example, the fourth threshold temperature is a minimum acceptable temperature of one or more components of the drive system 180 (e.g., minimum temperature batteries must be maintained).

If the control system 100 determines, at step 1509, that the sensed temperature of the components of the drive system 180 is greater than the fourth threshold temperature, the control system 100 does not send any immediate action control signals to other components of the system 40 and the control system 100 continuously monitors the sensed temperature of the components of the drive system 180.

However, if the control system 100 determines, at step 1510 that the sensed temperature of the components of the drive system 180 is less than the fourth threshold temperature, the control system 100 is configured to facilitate control of other components in the system 40 to thereby increase the temperature of the second heat transfer fluid to warm the components of the drive system 180. For example, the control system 100 operates pump 173 and/or the valves 176A-C and the PTC heater 183 to thereby circulate and heat the second heat transfer fluid until the components of the drive system 180, such as a battery, are warmed. Note that a component of the drive system 180, such as a battery, may also 'self-heat' as electric energy discharges to power to the PTC heater 183. After the components of the drive system 180 are warmed to their minimum threshold temperatures, the control system 100 can be further configured to turn off the PTC heater 1480 and cool the second heat transfer fluid such that excess heat from the components of the drive system 180 can be removed. In another example, the control system 100 operates the PTC heater 183 to heat the second heat transfer fluid until the components of the drive system 180, such as a battery, are warmed. In this example, no pumping of the second heat transfer fluid may be necessary. In another example, the control system 100 operates the pump 173 and/or the valves 176A-C such that the second heat transfer fluid is conveyed through the second closed loop circuit 170 and the pump 164 to draw in water from the body to water. Heat is transferred from the water to the second heat transfer fluid via the third heat exchanger 78C and the second heat transfer fluid warms the components of the drive system 180. The control system 100 may additionally or alternatively operate the PTC heater 183 to heat the second heat transfer fluid and thereby warm the components of the drive system 180.

Note that once the temperature of the components of the drive system 180 are warmed to the fourth threshold temperature, the control system 100 can be configured to facilitate control of other components in the system 40 to thereby decrease or maintain the temperature of the second heat transfer fluid to maintain a temperature of the components of the drive system 180. For example, the control system operates the pump 173 and/or the valves 176A-C such that the second heat transfer fluid is conveyed through the second closed loop circuit 170 and the pump 164 to draw in water from the body to water. Heat is transferred from the second heat transfer fluid to the water via the third heat exchanger 78C and the second heat transfer fluid cools the components of the drive system 180.

Figure 16:
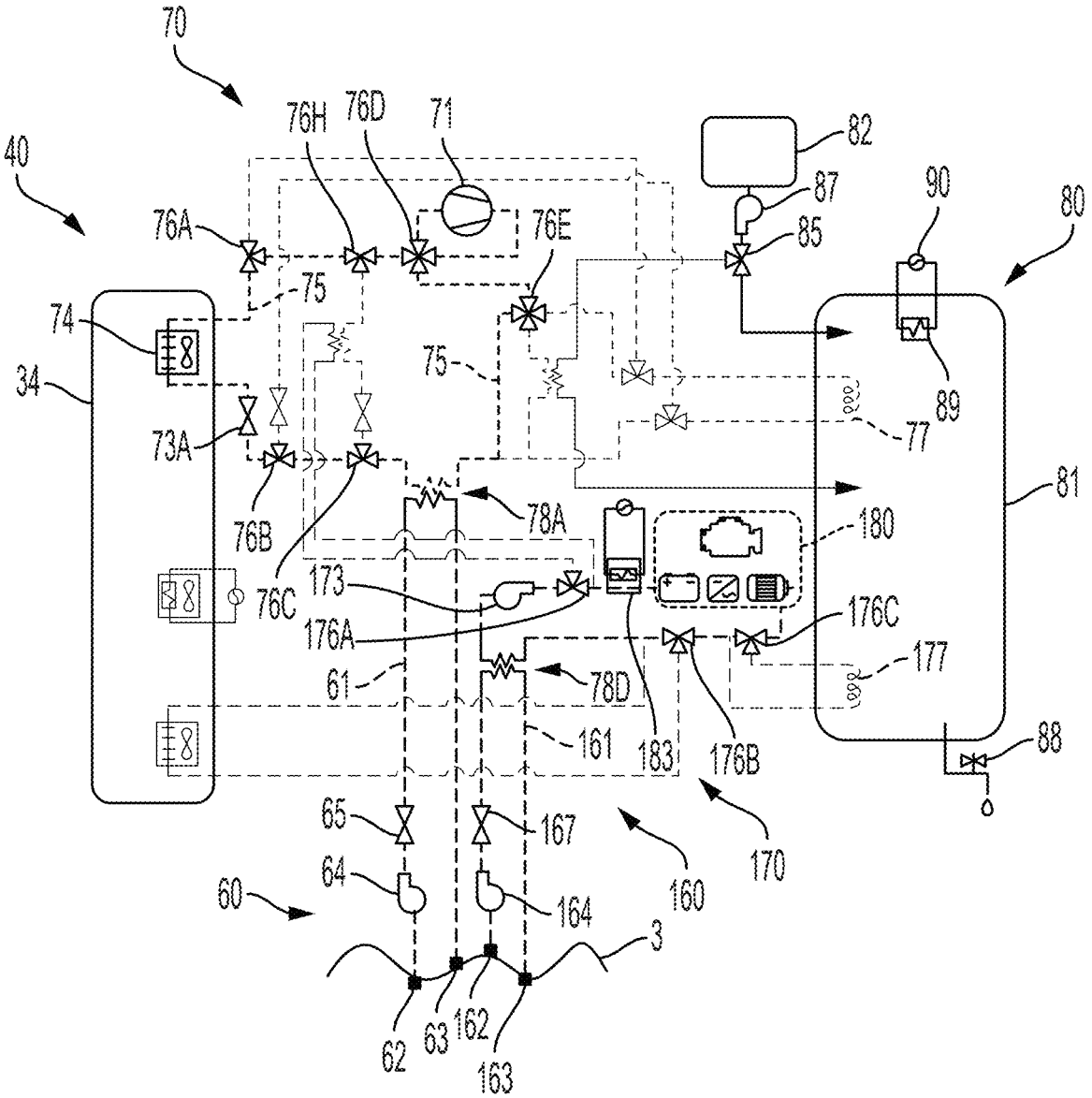

Optionally, as depicted in FIG. 16, the pump 64 pumps relatively warmer water from the body of water 3 through the first open loop circuit 60 to the first heat exchanger 78A. The first heat exchanger 78A is configured to exchange heat between the water and the first heat transfer fluid in the first closed loop circuit 70 thereby warms the first heat transfer fluid. The relatively cooler water is dispensed from the first open loop circuit 60 back into the body of water 3, and the body of water 3 acts as a heat source.

The first heat transfer fluid in the first closed loop circuit 70 flows to and warms a refrigeration component, e.g., the heat exchanging device 74, positioned in the cabin 34. The heat exchanging device 74 warms the air in the cabin 34. As such, the air in the cabin 34 is warmed to a comfortable temperature for the occupants compared to the relatively cooler air outside of the marine vessel 10.

The compressor 71 causes the first heat transfer fluid to be conveyed through the first closed loop circuit 70 and the expansion valve 73A. The control system 100 controls several valves 76A-H to facilitate flow of the first heat transfer fluid through the first closed loop circuit 70 as noted above.

In these examples, the control system 100 can be configured to sense the temperature of the air in the cabin 34 with a temperature sensor 50. The control system 100 receives signals from the temperature sensor 50 corresponding to the sensed temperature of the air in the cabin 34. The control system 100 compares the sensed temperature of the air in the cabin 34 to the fifth threshold temperature.

If the control system 100 determines, that the sensed temperature of the air in the cabin 34 is less than the fifth threshold temperature, the control system 100 is configured to facilitate control of other components in the system 40 to thereby increase the temperature of the air in the cabin 34. For example, the control system 100 operates the pumps 64, 164, the compressor 71, and/or the controls one more valves 76A-H such that the air is the cabin 34 is heated. The body of water 3 acts as a heat source for heating the air in the cabin 34.

Figure 17:
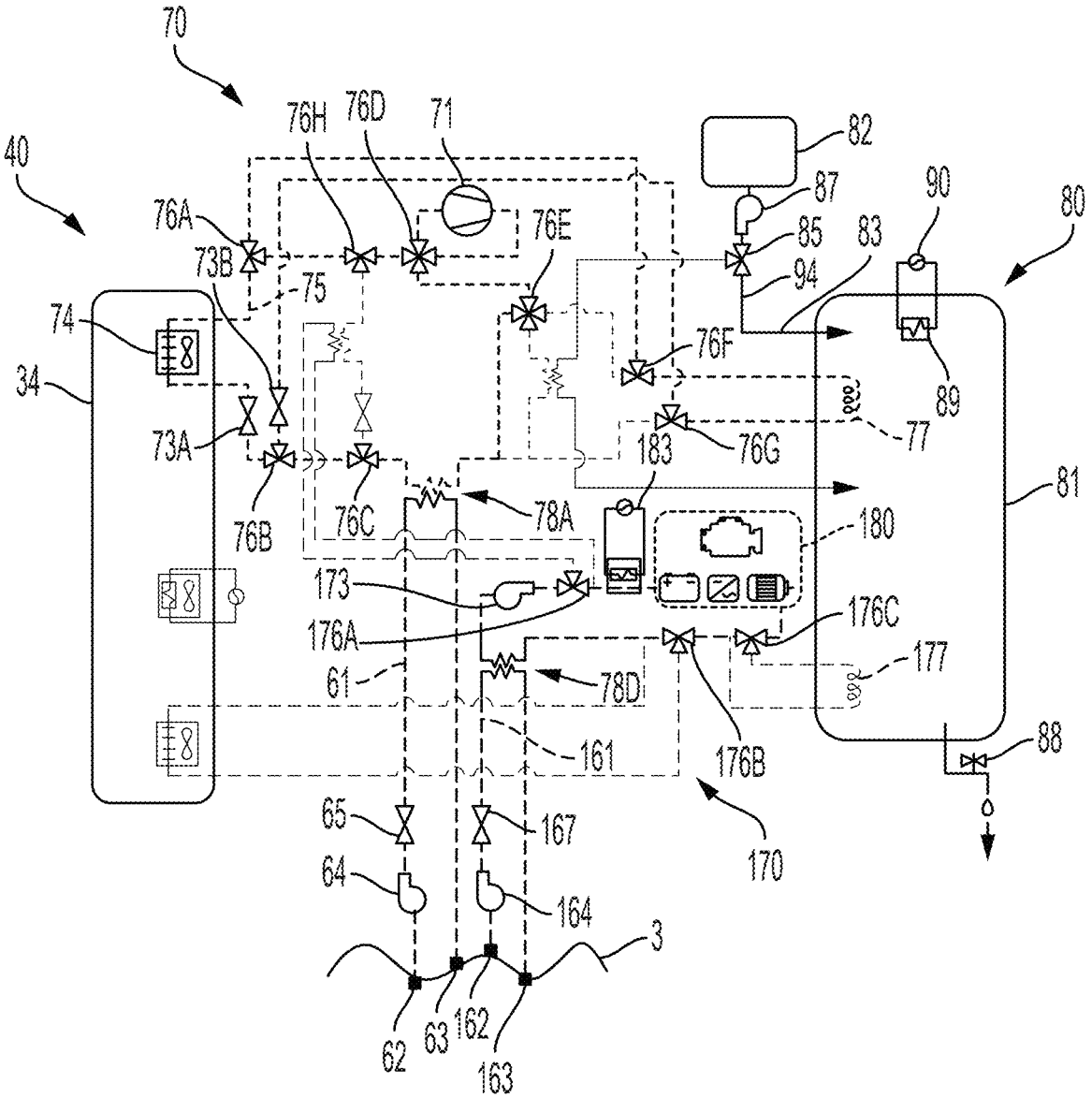

Optionally, as depicted in FIG. 17, the control system 100 controls several valves 76A-H to facilitate flow of the first heat transfer fluid through the first closed loop circuit 70 additionally through the coil 77. Heat is transferred from the first heat transfer fluid passing through the coil 77 to the potable water in the reservoir 81 thereby heating the potable water in the reservoir 81. In these examples, the control system 100 can be configured to sense temperatures of the first heat transfer fluid and/or the potable water to thereby determine if there is sufficient or insufficient heat in the first heat transfer fluid to heat the potable water in the water heater 80 (see other example methods of the present disclosure).

Figure 18:
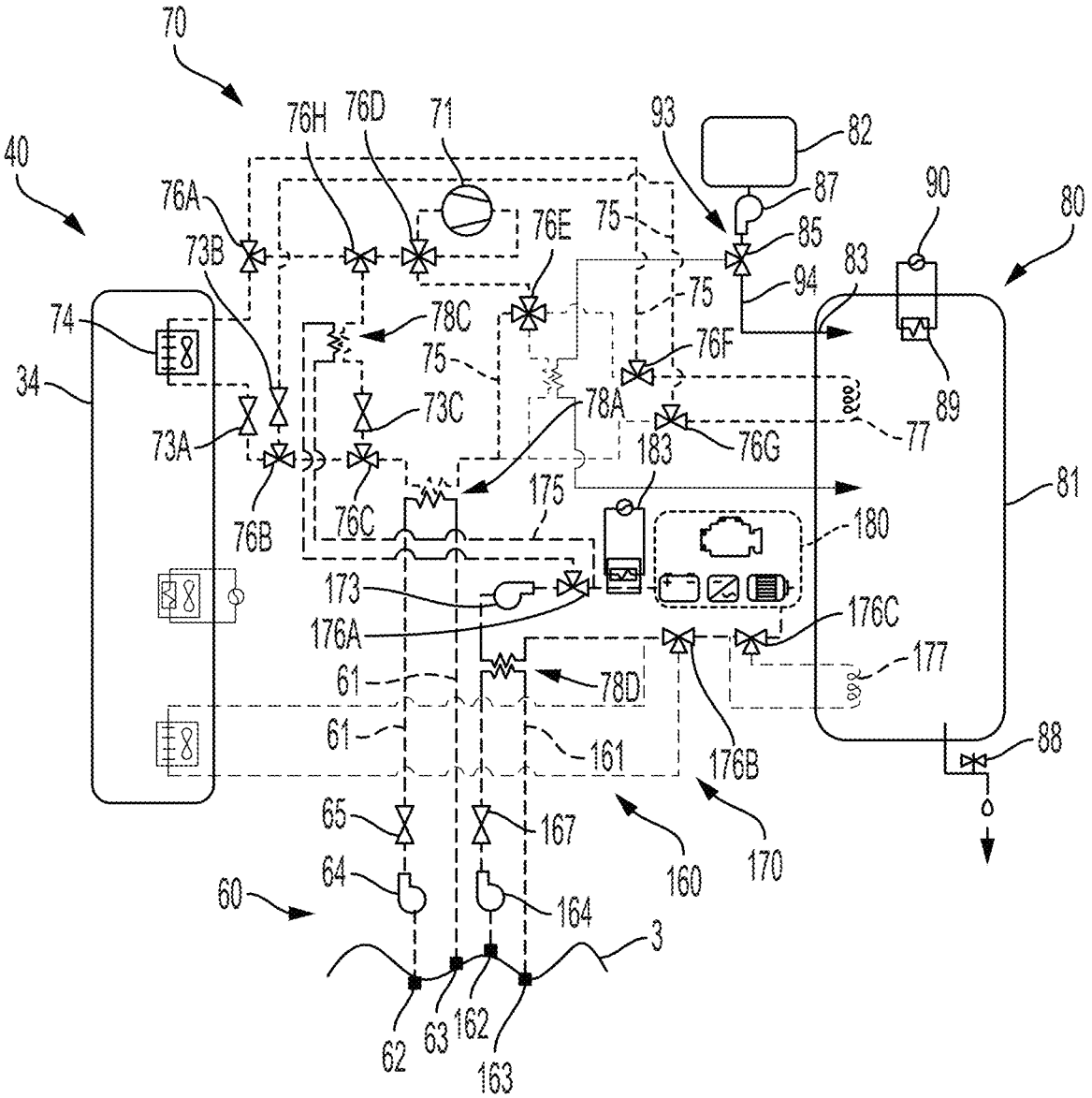

Optionally, as depicted in FIG. 18, the control system 100 controls one or more valves 76A-H to facilitate flow of the first heat transfer fluid through the first closed loop circuit 70 and additionally through the third heat exchanger 78C. As such, heat is transferred between the first heat transfer fluid in the first closed loop circuit 70 and the second heat transfer fluid in the second closed loop circuit 170. In one example, heat is transferred to the second heat transfer fluid and the second heat transfer fluid warms one or more components of the drive system 180. In another example, heat is transferred to the first heat transfer fluid such that the second heat transfer fluid is cooled and the one or more components of the drive system 180 are also cooled. The control system 100 is configured to monitor the temperatures of the air in the cabin 34 and/or the components and/or fluids of the system 40 to thereby transfer heat as needed.

Figure 19:
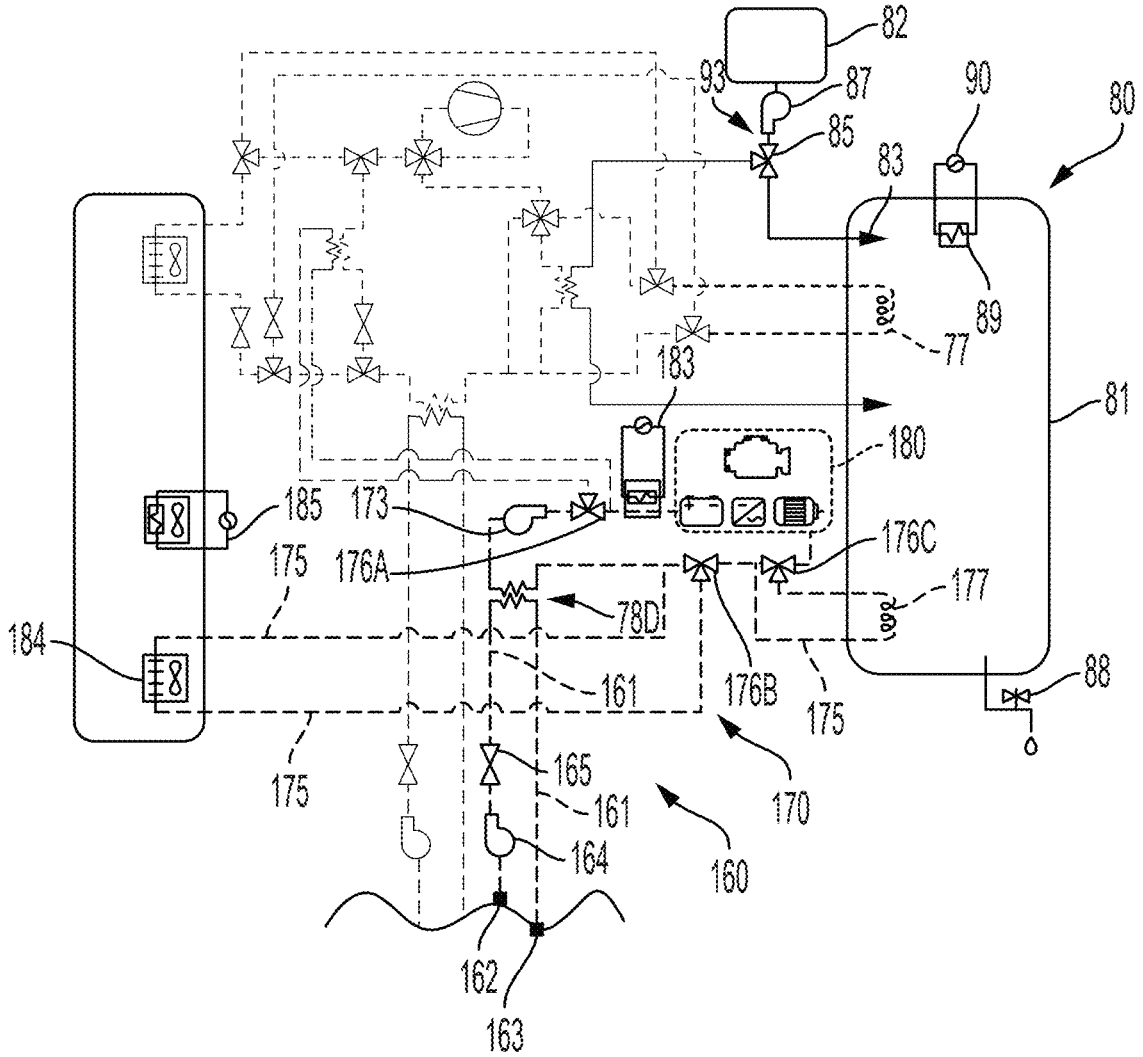

FIG. 19 depicts the thermal management system 40 in a seventh operational mode. The seventh operational mode is advantageously utilized during cold weather or winter days. In the example depicted, the drive system 180 is operating and generating heat. The system 40 is configured to cool the second heat transfer fluid. For example, the pump 164 pumps relatively cooler water from the body of water 3 through the second open loop circuit 160 to the fourth heat exchanger 78D. The fourth heat exchanger 78D is configured to exchange heat between the water and the second heat transfer fluid in the second closed loop circuit 170 thereby warms the water in the second open loop circuit. The warmed water is dispensed from the second open loop circuit 160 back into the body of water 3, and the body of water 3 acts as a heat sink.

The second heat transfer fluid in the second closed loop circuit 170 also flows to and warms a refrigeration component, e.g., the compartment heat exchanger 184, positioned in the cabin 34. The compartment heat exchanger 184 warms the air in the cabin 34 and/or the second heat transfer fluid transfers heat to the air in the cabin 34 via the compartment heat exchanger 184. As such, the air in the cabin 34 is warmed to a comfortable temperature for the occupants compared to the relatively cooler air outside of the marine vessel 10. As such the air in the cabin 34 acts as a heat sink for the excess heat generated by the drive system 180.

In certain examples, the second heat transfer fluid in the second closed loop circuit 170 is cooled as thermal energy transfers from the second heat transfer fluid to the water. The relatively cooler second heat transfer fluid flows to and cools one or more components of the drive system 180. The second heat transfer fluid absorbs heat from the cools one or more components of the drive system 180 and this relatively warmer second heat transfer fluid flows to the coil 177 and/or the compartment heat exchanger 184 for heating the potable water and/or the air in the cabin 34, respectively.

The pump 173 pumps the second heat transfer fluid through the second closed loop circuit 170. The control system 100 controls several valves 176A-C to facilitate flow of the second heat transfer fluid through the second closed loop circuit 170 as noted above and the coil 177.

The pump 87 pumps the potable water from the storage tank 82 through the valve 85 to the reservoir 81, and the heat is transferred from the second heat transfer fluid passing through the coil 177 to the potable water in the reservoir 81 thereby heating the potable water in the reservoir 81. Note that the coil 77 is depicted in gray lines as the first heat transfer fluid is not conveyed through the coil 77.

Figure 20:
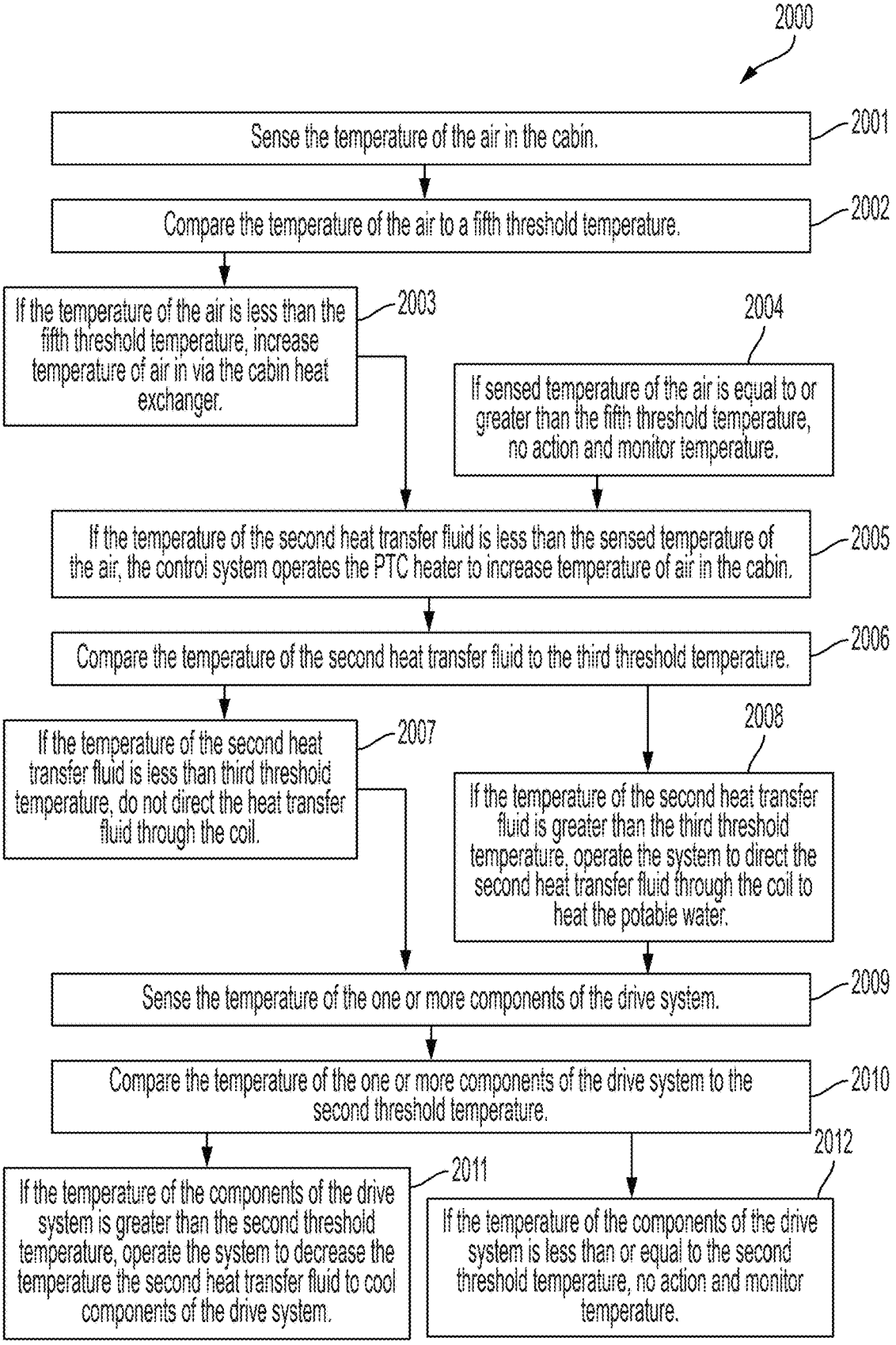

FIG. 20 depicts an example method 2000 for operating the thermal management system 40 in the seventh operational mode according to the present disclosure with reference to FIGS. 2 and 10. The method 2000 begins at step 2001 with a temperature sensor 50 (FIG. 3) sensing the temperature of the air in the cabin 34. The control system 100 receives signals from the temperature sensor 50 corresponding to the sensed temperature of the air in the cabin 34 and other temperature sensors 50 noted herein in this example method 1700. The control system 100 compares, at step 2002, the sensed temperature of the air in the cabin 34 to the fifth threshold temperature.

If the control system 100 determines, at step 2003, that the sensed temperature of the air in the cabin 34 is less than the fifth threshold temperature and the sensed temperature of the second heat transfer fluid is greater than the fifth threshold temperature, the control system 100 controls the other components in the system 40 to thereby increase the temperature of the air in the cabin 34. For example, the control system 100 operates the pump 164 and/or the controls one more valves 176A-C such that the second heat transfer fluid in the second closed loop circuit 170 flows to and transfers heat to the air in the cabin 34 via the compartment heat exchanger 184.

However, if the control system 100 determines, at step 2004 that the sensed temperature of the air in the cabin 34 is at or greater than the fifth threshold temperature, the control system 100 does not send any immediate action control signals to other components of the system 40 and the control system 100 continuously monitors the sensed temperature of the air in the cabin 34.

Further, if the control system 100 determines, at step 2005 that the sensed temperature of the second heat transfer fluid is less than the sensed temperature of the air in the cabin 34, the control system 100 controls the other components in the system 40 such as the PTC heater 185 to increase the temperature of the air in the cabin 34.

At step 2006, the control system 100 compares, the sensed temperature of the second heat transfer fluid to the third threshold temperature.

At step 2007, if the sensed temperature for the second heat transfer fluid is less than the third threshold temperature, the control system 100 determines that there is insufficient heat in the second heat transfer fluid to increase the temperature of the potable water in the water heater 80. Thus, the control system 100 controls one or more valves 176A-C such that the second heat transfer fluid does not flow through the coil 177.

If the control system 100 determines, at step 2008, that the sensed temperature for the second heat transfer fluid is greater than the third threshold temperature, the control system 100 determines that there is sufficient heat in the second heat transfer fluid to increase the temperature of the potable water in the water heater 80. Thus, the control system 100 controls one or more valves 176A-C such that the second heat transfer fluid does flow through the coil 177 and warms the potable water in the water heater 80.

At step 2009, a temperature sensor 50 senses the temperature of the one or more components of the drive system 180. The control system 100 compares, at step 2010, the sensed temperature of the one or more components of the drive system 180 to the second threshold temperature.

If the control system 100 determines, at step 2011, that the sensed temperature of the components of the drive system 180 is greater than the second threshold temperature, the control system 100 is configured to facilitate control of other components in the system 40 to thereby decrease the temperature of the second heat transfer fluid flowing through the second closed loop circuit 170 to cool the components of the drive system 180. For example, the control system 100 operates the pump 173 and/or the valves 176A-C to cool the second heat transfer fluid. Note that the heat transferred to the water heater 80 and/or the air in the cabin 34 (as described above) also cools the second heat transfer fluid. As such, the body of water 3, the water heater 80, and/or the air in the cabin 34 act as heat sinks. The control system 100 operates the pump 164 to pump relatively cooler water from the body of water 3 through the second open loop circuit 160 such that heat is transferred from the second heat transfer fluid in the second closed loop circuit 170 to the water in the second open loop circuit 160 via the fourth heat exchanger 78D. The heated water in the second open loop circuit 160 is returned to the body of water 3. At step 2012, if the sensed temperature of the components of the drive system 180 is less than or equal to the second threshold temperature, no action is taken by the control system 100 and the control system continuously monitors the temperature of the components of the drive system 180.

Figure 21:
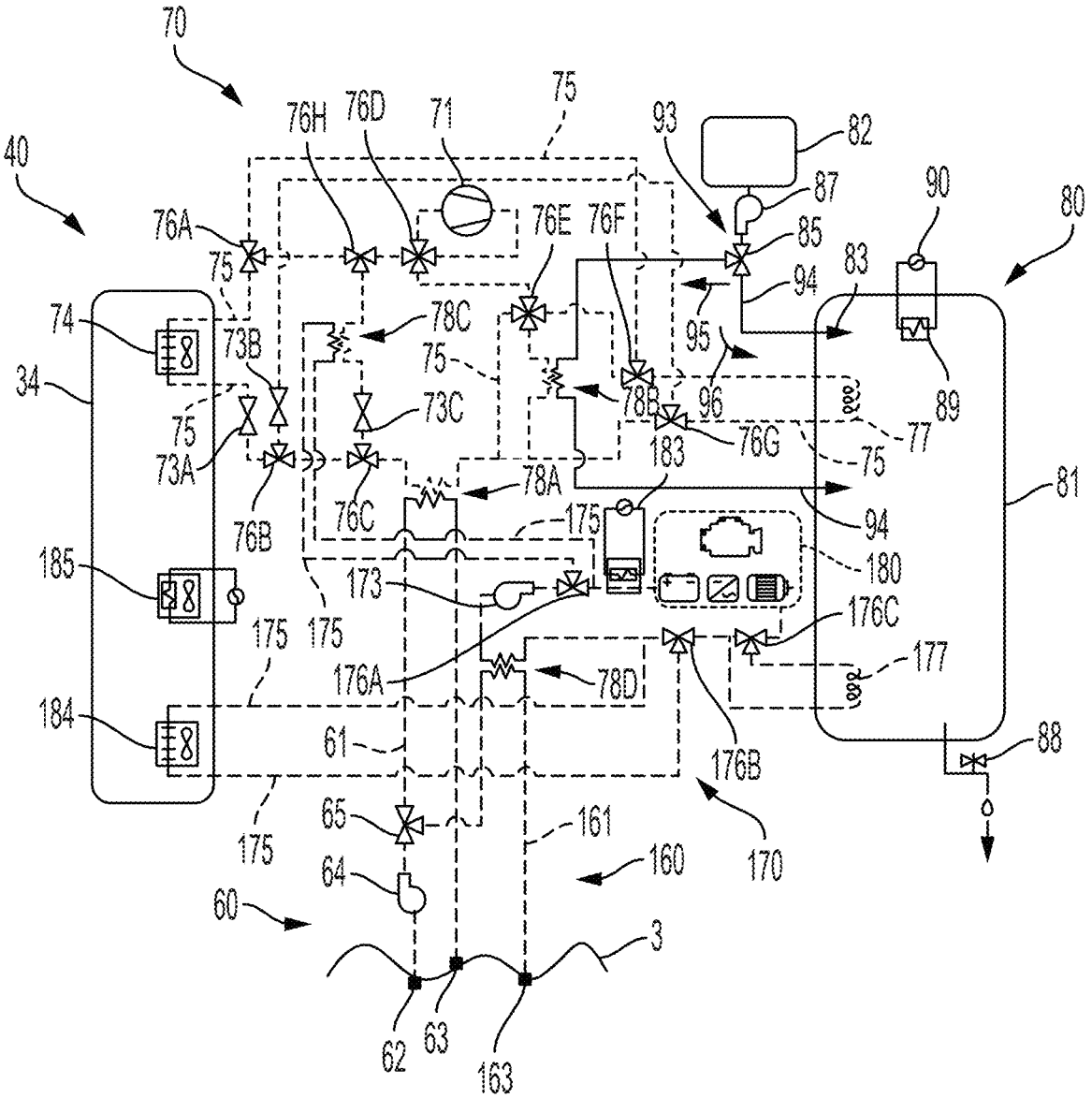

In the example thermal management system 40 depicted in FIG. 21, the pump 64 of the first open loop circuit 60 is configured to pump water through the first open loop circuit 60 and the second open loop circuit 160. The valve 65 is a three-way valve, and the open loop circuits are fluidly coupled to each other. The present inventors recognized providing a single pump 64 for pumping water through one or more circuits 60, 160 advantageously reduces space footprint of the system 40 and/or increases the efficiency of the system 40.

Figure 22:
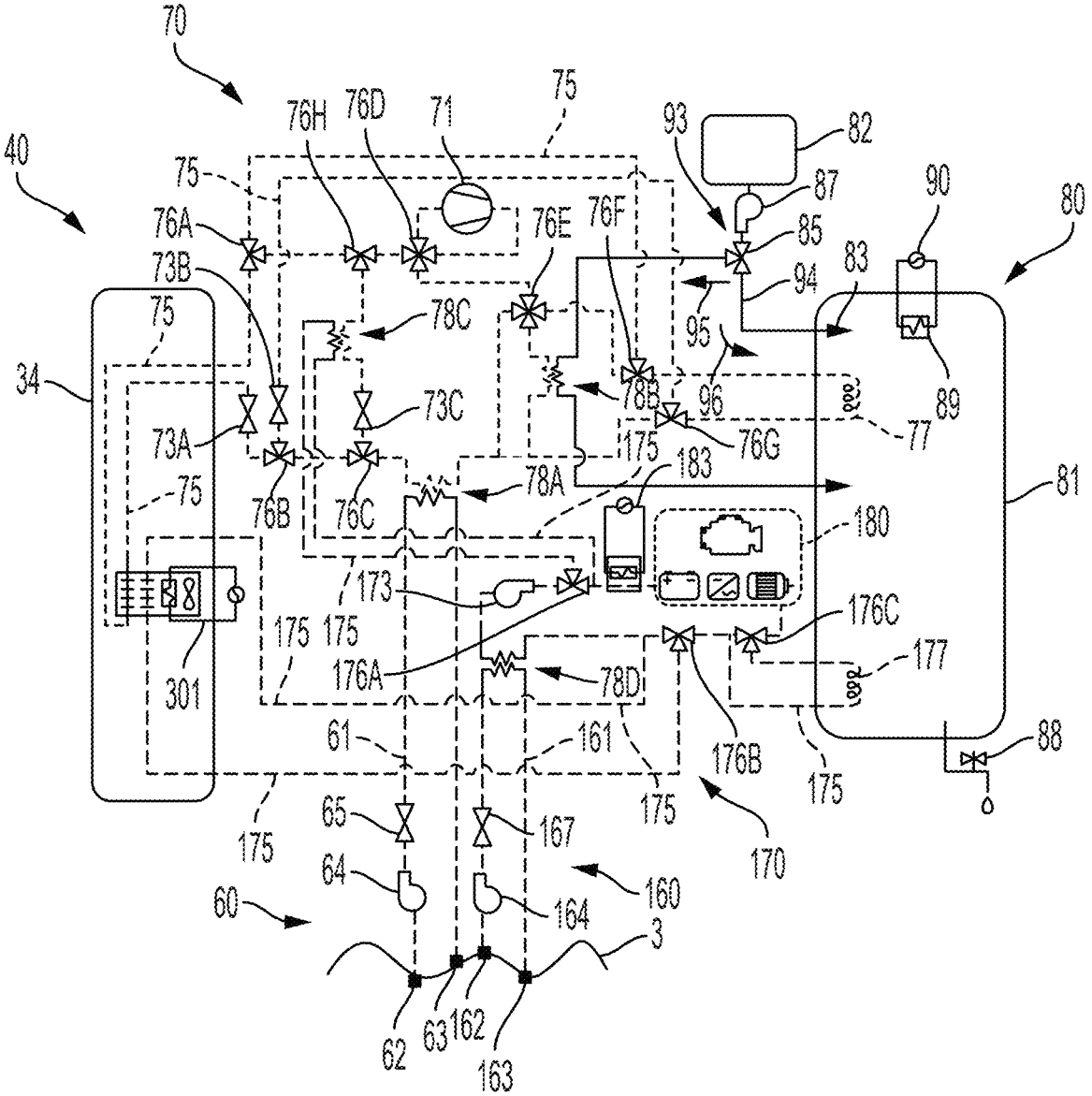

In the example thermal management system 40 depicted in FIG. 22, the heat exchanging device 74, the PTC heater 185, and/or the compartment heat exchanger 184 are replaced with a single device 301 which includes operational components and features of these replaced components. The device 301 is coupled to the first closed loop circuit 70 and/or the second closed loop circuit 170 such that the first and second heat transfer fluids can be conveyed through the device 301 to thereby cool and/or heat the air in the cabin 34. Furthermore, the device 301 includes a PCT heater or similar components which can also heat the air in the cabin 34. The present inventors recognized providing the single device 301 for different methods of heating or cooling the air in the cabin 34 advantageously reduces the space/footprint of the system 40 and/or increases the efficiency of the system 40.

Figure 23:
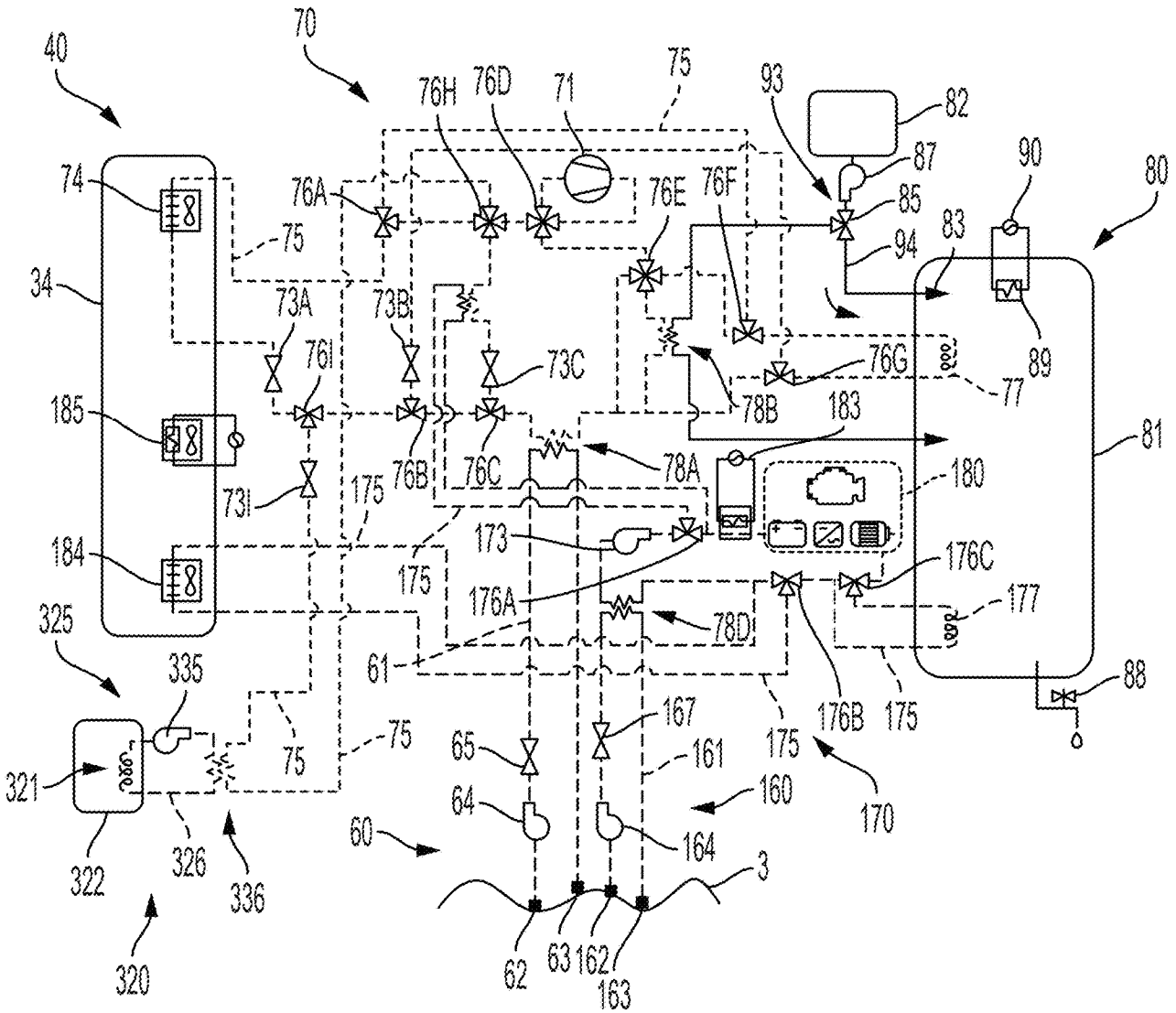

In the example thermal management system 40 depicted in FIG. 23, the refrigeration system 320 is coupled to associated with the first closed loop circuit 70. In this example, the first closed loop circuit 70 extends through the heat exchanger 336 and as such the first heat transfer fluid in the first closed loop circuit 70 transfers heat with the heat transfer fluid in the second refrigeration closed loop circuit 325. One or more of the valves 76A-H are operated to thereby direct the first heat transfer fluid to the refrigeration system 320. The control system 100 can be configured to monitor the temperature in the refrigeration space 321 (via a temperature sensor 50) and thereby selectively cool or heat the air in the refrigeration space 321 based on a refrigeration threshold temperature. Note that additional expansion valves 731 and valves 76I can be included with the first closed loop circuit 70 to facilitate connection to the refrigeration system 320.

It should be recognized that other methods are also contemplated by the present disclosure, and that these methods may be used for thermally managing components other than those expressly discussed and depicted herein.

It should be further recognized that while the present disclosure generally provided examples of thermal management systems 40 used in conjunction with marine vessels, other uses and context are also contemplated, including recreational vehicles (RVs) and other vehicles having components requiring cooling and/or heating. The present inventors have recognized unmet needs for thermally managing various refrigeration devices and systems. In certain examples, any heat loads that consume power for cooling or heating result in inefficiency and, particularly for vehicles that also use electric power for propulsion, reduced operating range. Therefore, to extend the operating range of these vehicles, it is important to improve efficiency of heat transfer and reuse heat where possible. In certain examples, the components, circuits, and/or system of the present disclosure can operate in heat pump mode are commonly employed to provide cooling and heating. In certain examples, one or more of the circuits 60, 70, 93, 160, 170, 190 of the system 40 could be operated in a heat pump mode such that heat is provided to one or more components or spaces of the marine vessel 10. In certain examples, the system 40 is required to provide battery cooling. The present inventors have recognized that the heating and cooling needs of power systems (e.g., batteries), propulsion devices, and house loads (e.g., HVAC) can be combined together for a more efficient thermal management system for vehicles.

In certain independent examples, a thermal management system for a marine vessel includes a first closed loop circuit in which a first heat transfer fluid is circulated, a first refrigeration component cooled or heated by the first heat transfer fluid and configured to cool or heat air within a compartment on the marine vessel, a first open loop circuit, a first pump configured to pump water from a body of water in which the marine vessel is operating, through the first open loop circuit, and back to the body of water, and a first heat exchanger configured to exchange heat between the first heat transfer fluid in the first closed loop circuit and the water in the first open loop circuit. The system includes a second closed loop circuit in which a second heat transfer fluid is circulated, a drive system with one or more components which are cooled or heated by the second heat transfer fluid, and a second heat exchanger configured to exchange heat between the second heat transfer fluid in the second closed loop circuit and the first heat transfer fluid in the first closed loop circuit.

Optionally, the first heat transfer fluid receives heat from the second heat transfer fluid via the first heat exchanger and the second heat transfer fluid cools the one or more components of the drive system. Optionally, a variable speed compressor is configured to convey the first heat transfer fluid. Optionally, a second pump is configured to pump the second heat transfer fluid through the second closed loop circuit. Optionally, the system includes a second open loop circuit and a second pump 164 configured to pump water from a body of water in which the marine vessel is operating, through the second open loop circuit, and back to the body of water and a third heat exchanger configured to exchange heat between the second heat transfer fluid in the second closed loop circuit and the water in the second open loop circuit. Optionally, the first heat transfer fluid receives heat from the second heat transfer fluid via the first heat exchanger and the water receives heat from the second heat transfer fluid via the third heat exchanger and the second heat transfer fluid cools the components of the drive system. Optionally, a water heater is configured to receive heat from the first heat transfer fluid in the first closed loop circuit and/or the second heat transfer fluid in the second closed loop circuit to thereby heat potable water in the water heater. Optionally, a water heater is configured to receive heat from the first heat transfer fluid in the first closed loop circuit to thereby heat potable water in the water heater, and a fourth heat exchanger is configured to exchange heat between the first heat transfer fluid and the potable water. Optionally, a water heater is configured to receive heat from the first heat transfer fluid in the first closed loop circuit to thereby heat potable water in the water heater and a coil through which the first heat transfer fluid is conveyed such that the first heat transfer fluid exchanges heat with the potable water via the coil. Optionally, a water heater is configured to receive heat from the second heat transfer fluid in the second closed loop circuit to thereby heat potable water in the water heater and a coil through which the second heat transfer fluid is conveyed such that the second heat transfer fluid exchanges heat with the potable water via the coil. Optionally, a compartment heat exchanger through which the second closed loop circuit extends and configured to exchange heat between the second heat transfer fluid and the air within the compartment. Optionally, the compartment heat exchanger is configured such that the air in the compartment receives heat from the second heat transfer fluid and the second heat transfer fluid cools the components of the drive system.

In certain independent examples, a method for operating a thermal management system of a marine vessel includes circulating a first heat transfer fluid through a first closed loop circuit, cooling or heating a refrigeration component with the first heat transfer fluid such that the refrigeration component cools or heats air in a compartment of the marine vessel, pumping water from a body of water in which the marine vessel is operating through a first open loop circuit and back to the body of water, circulating a second heat transfer fluid through a second closed loop circuit, cooling or heating one or more components of a drive system with the second heat transfer fluid, and exchanging heat between the second heat transfer fluid in the second closed loop circuit and the first heat transfer fluid in the first closed loop circuit.

Optionally, the method includes pumping water from a body of water in which the marine vessel is operating through a second open loop circuit and back to the body of water and exchanging heat between the second heat transfer fluid of the second closed loop circuit and the water in the second open loop circuit. Optionally, wherein the exchanging heat between the second heat transfer fluid in the second closed loop circuit and the first heat transfer fluid in the first closed loop circuit is facilitated by a first heat exchanger; and wherein the exchanging heat between the second heat transfer fluid of the second closed loop circuit and the water in the second open loop circuit is facilitated by a second heat exchanger. Optionally, the method includes receiving heat into a water heater from the first closed loop circuit and/or the second closed loop circuit to thereby heat potable water in the water heater. Optionally, the method includes exchanging heat between the first heat transfer fluid in the first closed loop circuit and potable water in a potable water in a potable by conveying the first heat transfer fluid and the potable water through a heat exchanger. Optionally, the method includes conveying the first heat transfer fluid through a coil and exchanging heat between the first heat transfer fluid in the first closed loop circuit and potable water in a potable water via the coil. Optionally, the method includes conveying the second heat transfer fluid through a coil and exchanging heat between the second heat transfer fluid in the second closed loop circuit and potable water in a potable water via the coil. Optionally, the method includes conveying the second heat transfer fluid through a compartment heat exchanger and exchanging heat between the second heat transfer fluid in the second closed loop circuit and the air in the compartment of the marine vessel via the compartment heat exchanger to thereby cool or heat the air in the compartment of the marine vessel.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives, and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A thermal management system for a marine vessel, the thermal management system comprising:

a first closed loop circuit in which a first heat transfer fluid is circulated;

a first refrigeration component cooled or heated by the first heat transfer fluid and configured to cool or heat air within a compartment on the marine vessel;

a first open loop circuit;

a first pump configured to pump water from a body of water in which the marine vessel is operating, through the first open loop circuit, and back to the body of water;

a first heat exchanger configured to exchange heat between the first heat transfer fluid in the first closed loop circuit and the water in the first open loop circuit;

a second closed loop circuit in which a second heat transfer fluid is circulated;

a drive system with one or more components which are cooled or heated by the second heat transfer fluid; and a second heat exchanger configured to exchange heat between the second heat transfer fluid in the second closed loop circuit and the first heat transfer fluid in the first closed loop circuit.

2. The thermal management system according to claim 1, wherein the first heat transfer fluid receives heat from the second heat transfer fluid via the second heat exchanger and the second heat transfer fluid cools the one or more components of the drive system.

3. The thermal management system according to claim 1, further comprising a variable speed compressor configured to convey the first heat transfer fluid.

4. The thermal management system according to claim 1, further comprising a second pump configured to pump the second heat transfer fluid through the second closed loop circuit.

5. The thermal management system according to claim 1, further comprising:

a second open loop circuit;

a second pump configured to pump water from a body of water in which the marine vessel is operating, through the second open loop circuit, and back to the body of water; and a third heat exchanger configured to exchange heat between the second heat transfer fluid in the second closed loop circuit and the water in the second open loop circuit.

6. The thermal management system according to claim 5, wherein the first heat transfer fluid receives heat from the second heat transfer fluid via the second heat exchanger and the water receives heat from the second heat transfer fluid via the third heat exchanger such that the second heat transfer fluid cools the one or more components of the drive system.

7. The thermal management system according to claim 1, further comprising a water heater is configured to receive heat from the first heat transfer fluid in the first closed loop circuit and/or the second heat transfer fluid in the second closed loop circuit to heat potable water in the water heater.

8. The thermal management system according to claim 1, further comprising:

a water heater configured to receive heat from the first heat transfer fluid in the first closed loop circuit to heat potable water in the water heater; and a fourth heat exchanger configured to exchange heat between the first heat transfer fluid and the potable water.

9. The thermal management system according to claim 1, further comprising:

a water heater configured to receive heat from the first heat transfer fluid in the first closed loop circuit to thereby heat potable water in the water heater; and a coil through which the first heat transfer fluid is conveyed such that the first heat transfer fluid exchanges heat with the potable water via the coil.

10. The thermal management system according to claim 1, further comprising:

a water heater configured to receive heat from the second closed loop circuit to thereby heat potable water in the water heater; and a coil through which the second heat transfer fluid is conveyed such that the second heat transfer fluid exchanges heat with the potable water via the coil.

11. The thermal management system according to claim 1, further comprising:

a compartment heat exchanger through which the second closed loop circuit extends and configured to exchange heat between the second heat transfer fluid and the air within the compartment.

12. The thermal management system according to claim 11, wherein the compartment heat exchanger is configured such that the air in the compartment receives heat from the second heat transfer fluid and the second heat transfer fluid cools the components of the drive system.

13. A method for operating a thermal management system of a marine vessel, the method comprising:

circulating a first heat transfer fluid through a first closed loop circuit;

cooling or heating a refrigeration component with the first heat transfer fluid such that the refrigeration component cools or heats air in a compartment of the marine vessel;

pumping water from a body of water in which the marine vessel is operating through a first open loop circuit and back to the body of water;

exchanging heat between the first heat transfer fluid of the first closed loop circuit and the water in the first open loop circuit;

circulating a second heat transfer fluid through a second closed loop circuit;

cooling or heating one or more components of a drive system with the second heat transfer fluid; and exchanging heat between the second heat transfer fluid in the second closed loop circuit and the first heat transfer fluid in the first closed loop circuit.

14. The method according to claim 13, further comprising:

pumping water from a body of water in which the marine vessel is operating through a second open loop circuit and back to the body of water; and exchanging heat between the second heat transfer fluid of the second closed loop circuit and the water in the second open loop circuit.

15. The method according to claim 14, wherein the exchanging heat between the second heat transfer fluid in the second closed loop circuit and the first heat transfer fluid in the first closed loop circuit is facilitated by a first heat exchanger; and wherein the exchanging heat between the second heat transfer fluid of the second closed loop circuit and the water in the second open loop circuit is facilitated by a second heat exchanger.

16. The method according to claim 13, further comprising receiving heat into a water heater from the first closed loop circuit and/or the second closed loop circuit to thereby heat potable water in the water heater.

17. The method according to claim 13, further comprising exchanging heat between the first heat transfer fluid in the first closed loop circuit and potable water in a water heater by conveying the first heat transfer fluid and the potable water through a heat exchanger.

18. The method according to claim 13, further comprising conveying the first heat transfer fluid through a coil; and exchanging heat between the first heat transfer fluid in the first closed loop circuit and potable water in a water heater via the coil.

19. The method according to claim 13, further comprising conveying the second heat transfer fluid through a coil; and exchanging heat between the second heat transfer fluid in the second closed loop circuit and potable water in a water heater via the coil.

20. The method according to claim 13, further comprising conveying the second heat transfer fluid through a compartment heat exchanger; and exchanging heat between the second heat transfer fluid in the second closed loop circuit and the air in the compartment of the marine vessel via the compartment heat exchanger to thereby cool or heat the air in the compartment of the marine vessel.

* * * * *